US005797330A

United States Patent [19]

Li

[11] Patent Number: 5,797,330

[45] Date of Patent: Aug. 25, 1998

[54] MASS TRANSIT SYSTEM

[76] Inventor: Zhengzhong Li, 62-61 Dieterle Crescent, Rego Park, N.Y. 11374

[21] Appl. No.: 688,842

[22] Filed: Jul. 31, 1996

[51] Int. Cl.[6] ..... B61B 1/00

[52] U.S. Cl. ..... 104/28; 104/88.4; 104/119; 701/19

[58] Field of Search ..... 104/27, 28, 88.3, 104/88.4, 118, 119, 296, 299; 105/141, 144; 246/3, 167 R; 364/424.03; 701/19

[56] References Cited

U.S. PATENT DOCUMENTS

| | | | |
|---|---|---|---|
| 3,583,325 | 6/1971 | Melin | 104/25 |
| 3,987,734 | 10/1976 | Horn | 104/88.03 |
| 4,071,135 | 1/1978 | Ishikawa et al. | 198/324 |
| 4,557,373 | 12/1985 | Paurat et al. | 198/819 |
| 4,565,276 | 1/1986 | Dengs et al. | 198/321 |
| 4,635,783 | 1/1987 | Hofling | 198/321 |
| 5,237,931 | 8/1993 | Riedl | 104/28 |
| 5,267,173 | 11/1993 | Tanizawa et al. | 104/88.03 |
| 5,289,778 | 3/1994 | Romine | 104/88.04 |
| 5,570,637 | 11/1996 | Wagner | 104/28 |

OTHER PUBLICATIONS

Current PRT and Related Systems Development Efforts.

*Primary Examiner*—S. Joseph Morano
*Attorney, Agent, or Firm*—Goldstein & Canino

[57] ABSTRACT

A mass transit system provides an on-demand transportation system including private vehicles to provide point to point non-stop transport from a first passenger station to a second station within an area serviced by the system. The system includes a plurality of self-propelled passenger vehicles with each vehicle suitable to transport a plurality of passengers. A network of interconnected tracks including main tracks and holding tracks are provided. The main tracks provide the main conduits for the passenger vehicles to move within the network, while the holding tracks provide a location to hold unoccupied vehicles that are available to be dispatched for passenger transport. The system also provides a plurality of passenger stations wherein each station is removed and decoupled from the main tracks. In addition to the main tracks and holding tracks, ramps are included to enable passenger vehicles to move between the respective passenger stations and the main tracks and the holding tracks. The system applies destination concerned priority to prevent the occurrence of congestion and bottlenecks within the network of tracks. Also provided are a variety of electronic and electromechanical units to support the overall function of the mass transit system.

19 Claims, 16 Drawing Sheets

MASS TRANSIT SYSTEM

BACKGROUND OF THE INVENTION

1. Field Of The Invention

The invention relates generally to mass transit systems, and more particularly to an on-demand computer controlled mass transit system wherein an individual can request an immediate pickup at a first passenger station and be transported non-stop to a second passenger station of choice.

2. Background And Objects Of The Invention

The appeal and desire to provide efficient, convenient, and economical mass transit systems is well known in the art. This is especially true when considering urban and highly developed suburban locations. In these locations the need is especially great during so called "rush-hour" periods when the number of riding individuals is at a peak. During rush-hour periods, congestion within a transportation system can cause a significant increase in waiting times, both at passenger pickup and drop-off locations, as well as when vehicles are in transit from one location (e.g. a station) to another. Those skilled in the art will appreciated the fact that the current state-of-the-art technology can support systems that are greatly advanced when compared with those currently in use.

When considering the "public" forms of transportation available there are significant problems with each. These problems often encourage individuals to select alternate forms of transportation, most notably the passenger automobile. For example, subway and rail systems require individuals to wait at stations for a vehicle that is traversing a known and fixed route to arrive. Should an individual or party of individuals arrive at a passenger station shortly after a train has departed, a substantial wait may be required before the next train servicing that route arrives. The need for an on-demand system, wherein an individual or party of individuals requests a transport from a first location to a second location, would be a significant improvement to this arrangement. Another undesirable feature of train and rail systems is that the train of vehicles moving along a respective route will make many "stops" to allow passengers to embark or debark. As a result, the time required to be transported from a first passenger station to a second passenger station is greatly increased from a minimum time that is theoretically possible. For example, consider a scenario where a vehicle would pickup passengers at a first station, leave that station and carry the passengers directly to a second station with out having to pause or slow down along the selected route, and enabling passengers to quickly debark at the second station. Those skilled in the art will recognize that the architecture of the current systems are not capable of supporting the above "direct non-stop" transport of passengers from one location to another. In addition, should a train or subway vehicle fail, the entire "line" that the vehicle is serving may be delayed or shut down.

Another problem associated with current state of the art mass transit systems, including subways, trains, and buses, is their inability to provide the level of privacy equivalent to say, an automobile or similar private vehicle. Many individuals have an aversion to being packed into vehicles with a large number of other individuals, especially during rush hour periods. As a result, individuals will often turn to the passenger automobile for transportation.

Commercial taxi vehicles and systems are well known in the art. While these vehicles do offer direct transport, with the desired level of individual privacy, they do so at a premium cost. This cost is prohibitive for many individuals looking for a low or moderate cost means of effect transportation. This is especially true for individuals that are commuting to and from work. In addition, taxi vehicles are subject to significant delays during rush-hour periods, and during times of severe weather events - particularly in urban settings. Further, taxi based systems are known to produce and discharge large amounts of pollutants directly into the atmosphere.

Another system known in the art is a proposed "personal rapid transit" system called the PRT 2000 system. This system utilizes small and personal vehicles that ride on narrow guideways, and enables passengers to travel non-stop between two stations. Accordingly, the PRT 2000 system includes off-line (decoupled) stations that enable passenger vehicles to stop at a station and typically not affect the flow of vehicular traffic on the main line. Although this system includes a number of improvements over vehicles and systems presently in use, it does not provide a simple and modular architecture, and further, this system is susceptible to "bottlenecks" and congestion. The bottlenecks and congestion may result when the capacity of a given station is exceeded. For example, if a number of passenger vehicles arrive at a respective passenger station at the same time, the vehicles may exceed the capacity of the station so that other arriving vehicles may "block" the flow of vehicles on the main guideway servicing the station. That is, the PRT 2000 system does not provide a means to prevent the capacity of a station from being exceeded (say during rush hour) by the occurrence of a number of overlapping and simultaneous vehicle arrives at the respective station. In addition, as a plurality of vehicles arrive at a station, they must be sent back (occupied or unoccupied) onto the main guideway to enable other arrives to be handled. Thus, the PRT 2000 system does not provide for the local "holding" of vehicles until they are needed for use.

When considering the problems and drawbacks of current and proposed mass transit systems, as discussed above, there is a need for new and improved systems that provide more efficient, more modular, and more fault tolerant architectures that improve the level of service available to passengers. Objects of the present invention are, therefore, to provide new and improved mass transit systems for transporting one or more individuals, in a non-stop fashion, from a first location within a network of pathways to a second location within said network. The present invention having one or more of the following capabilities, features, and/or characteristics:

- an on-demand mass transit system;
- support the direct transport between two respective stations without slowing or stopping at a plurality of (other) stations along the designated route;
- rapid and efficient transport of a very high volume of passengers made possible by utilizing the full capacity of, and eliminating stopping at unwanted passenger stations along, the main track means;
- reduces or prevents the occurrence of bottlenecks that may cause congestion or "backups" within the network by employing a "destination concerned priority" scheme;
- having self propelled driverless vehicles;
- an efficient system that greatly reduces operational noise levels and the discharging of pollutants produced by vehicles of the system;
- reduce the congestion of traffic traveling on conventional roadways;
- significantly reduce the time required for individuals to be transported from a first passenger station to a second passenger station;

eliminate the occurrence of vehicle collisions;

a system wherein the passenger vehicles are "waiting" at a location within the immediate vicinity of a passenger station;

the rapid dispatching of one or more vehicles to pickup one or more individuals requesting transport;

low cost construction;

includes ramps to enable vehicles to exit the primary track means and enter a station area where passengers are dropped off or picked up thereby having a negligible affect on the flow of traffic on the main track;

enable vehicles in the station areas to pickup speed and subsequently merge with main track vehicles so that the speed of the main track traffic is not affected by merging vehicles;

enable specific vehicles in operation on the network to be located and tracked as required;

supply system operators with a variety of information related to vehicle operation and movement to assist in the overall operation of the system;

enable the transport of cargo and hazardous materials during off-peak and late night hours;

a distributed and simple modular system architecture;

a relatively low-cost user friendly system using many "off-the-shelf" parts.

The above listed objects, advantages, and associated novel features of the present invention, as well as others, will become more clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the invention, an on-demand mass transit system is disclosed to enable individuals to transport from a first location to a second location, both locations being within an area serviced by the system. The system includes a plurality of self-propelled mass transit passenger vehicles, wherein each passenger vehicle is capable of transporting passengers from the first initial location to the second destination location. A network of interconnected tracks is provided including main tracks and holding tracks. The main tracks provide the main conduits for the passenger vehicles to move within the network, while the holding tracks are included to hold unoccupied vehicles that are available to be dispatched to transport passengers. A plurality of passenger stations, including a first station at the first location and a second station at the second location, are provided and located adjacent to the main tracks. Each passenger station is removed and decoupled from the main track so as to support the pick-up and drop-off of passengers while not affecting the flow of vehicular traffic on the main track. Ramp means are included to enable passenger vehicles to move between the respective passenger stations and at least one of a portion of the main track and one portion of the holding track (at each of the stations). Also provided with the invention are a plurality of station interface units and a computing means. At least one of the station interface units are installed in each of the plurality of passenger stations to enable individuals to request a pickup at the first station by one of the passenger vehicles and to specify the second station to be transported to. The computing means, which is provided to control and coordinate the activities of the mass transit system, is in communication with each of the station interface unit to enable the exchange of information between the computing means and the station interface units so as to process and coordinate the vehicle requests for transport by individuals, and further to process information received related to the position and speed of the plurality of the passenger vehicles in operation on the network of tracks and provide appropriate control information. The computing means will also implement a destination concerned priority scheme to prevent the simultaneous arrival of too many passenger vehicles at a respective station, which will result in the exceeding of the capacity of station, thereby causing a bottleneck condition.

The ramp means provided with the invention enable passenger vehicles that are not presently in use to be dispatched by the computing means from the holding track to the first station to pick up one or more passengers who have requested transport, to enable occupied passenger vehicles to move from the first station to the main track to commence transport to the second station, to enable passenger vehicles to move from the main track to the second station to drop-off passengers, and enable passenger vehicles to be moved from the second station to one of the holding tracks of the system. The holding tracks would hold the passenger vehicles until one or more are needed to transport passengers.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It is important to clearly define a number of terms that will be used throughout this disclosure. The terms "mass transit" and "mass transit system" will be defined as any system employing vehicular components that are capable of carrying a plurality of passengers, and serve a relatively large area, say several square miles. Such systems typically involve the contemporaneous operation of a plurality of vehicles (often in large numbers). The terms, "mass transit passenger vehicle", "passenger vehicle", and more generally "vehicle", will refer a vehicle that is capable of carrying a plurality of individuals, say approximately ranging from 1 to 6, which is employed to transport passengers within an area serviced by the mass transit system. Further, when describing passenger drop-off and pickup locations, the terms "station", "passenger station", and "station arrangement" will be used interchangeably and are intended to convey the same meaning. In addition, the passenger stations may generally include a building having "platforms", which are located immediately adjacent to one or more sections of track means 22, and may actually be provided in non-traditional locations, such as office buildings, shopping malls, schools, hospitals, and the like. Further, the term "station" or its equivalents, as applied to the present invention, may most generally be considered any location within the network wherein passengers may request a pickup or be dropped off. Finally, it is contemplated that the vehicles of the invention travel on "track means", such as traditional train or monorail type track means. However, the track means are to be understood to include any means that will support the guided movement of a vehicle from one location to another, without the use of an individual acting as a "driver". When considering a plurality of interconnected track means, the terms "network", "network of tracks", or "network of pathways", will be understood to be equivalents.

Figure 1A:
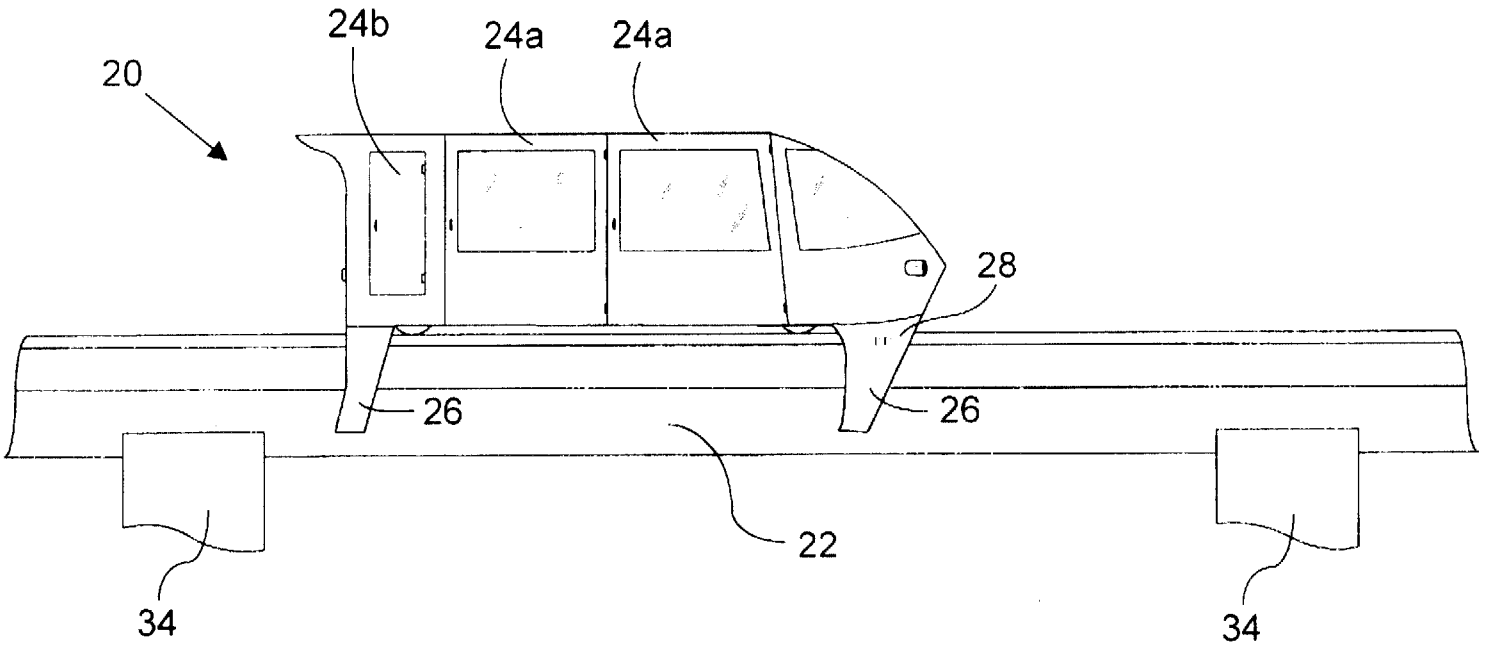
FIG. 1A provides a side view of an embodiment of a mass transit vehicle and a track means in accordance with the invention.
Figure 1B:
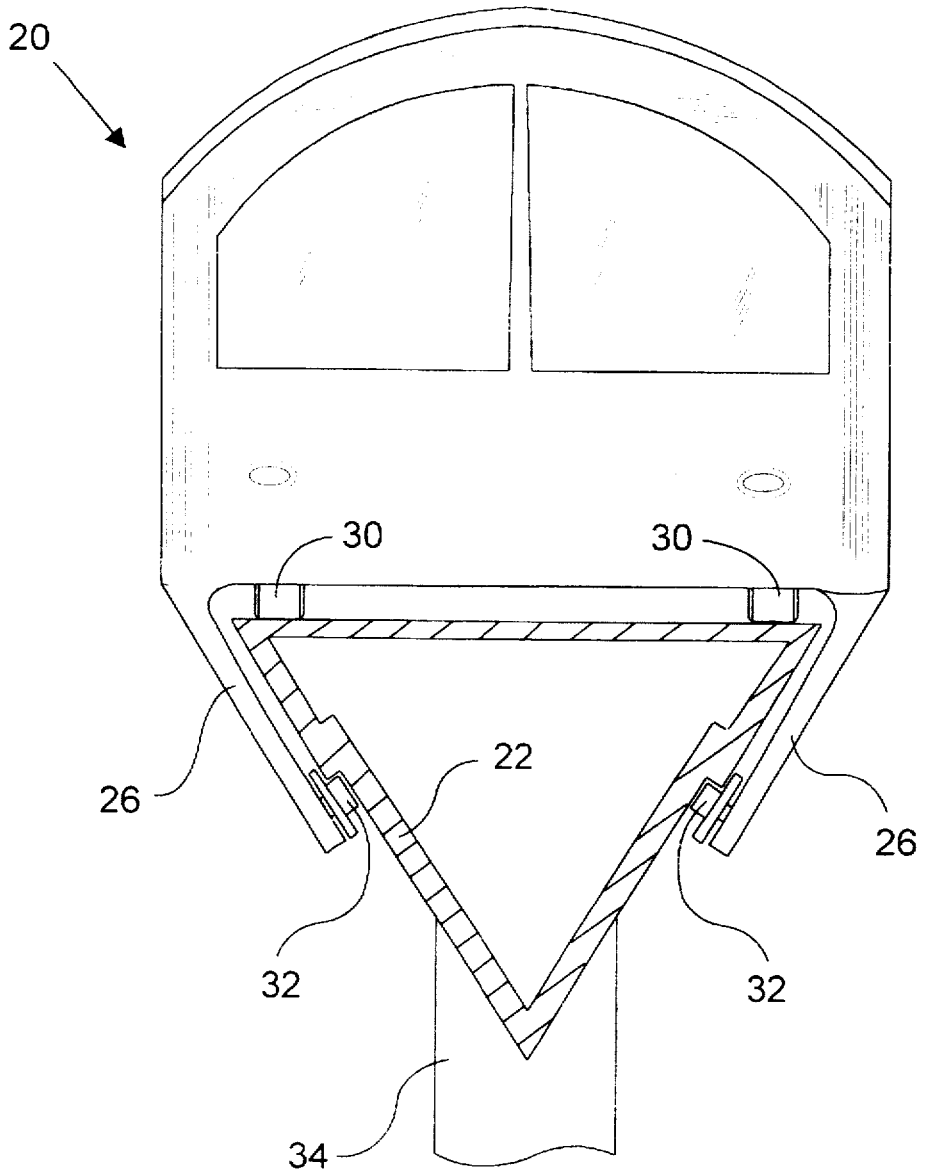
FIGS. 1B and 1C depict end views of the rear of two embodiments of the vehicle of FIG. 1A.
Figure 1C:
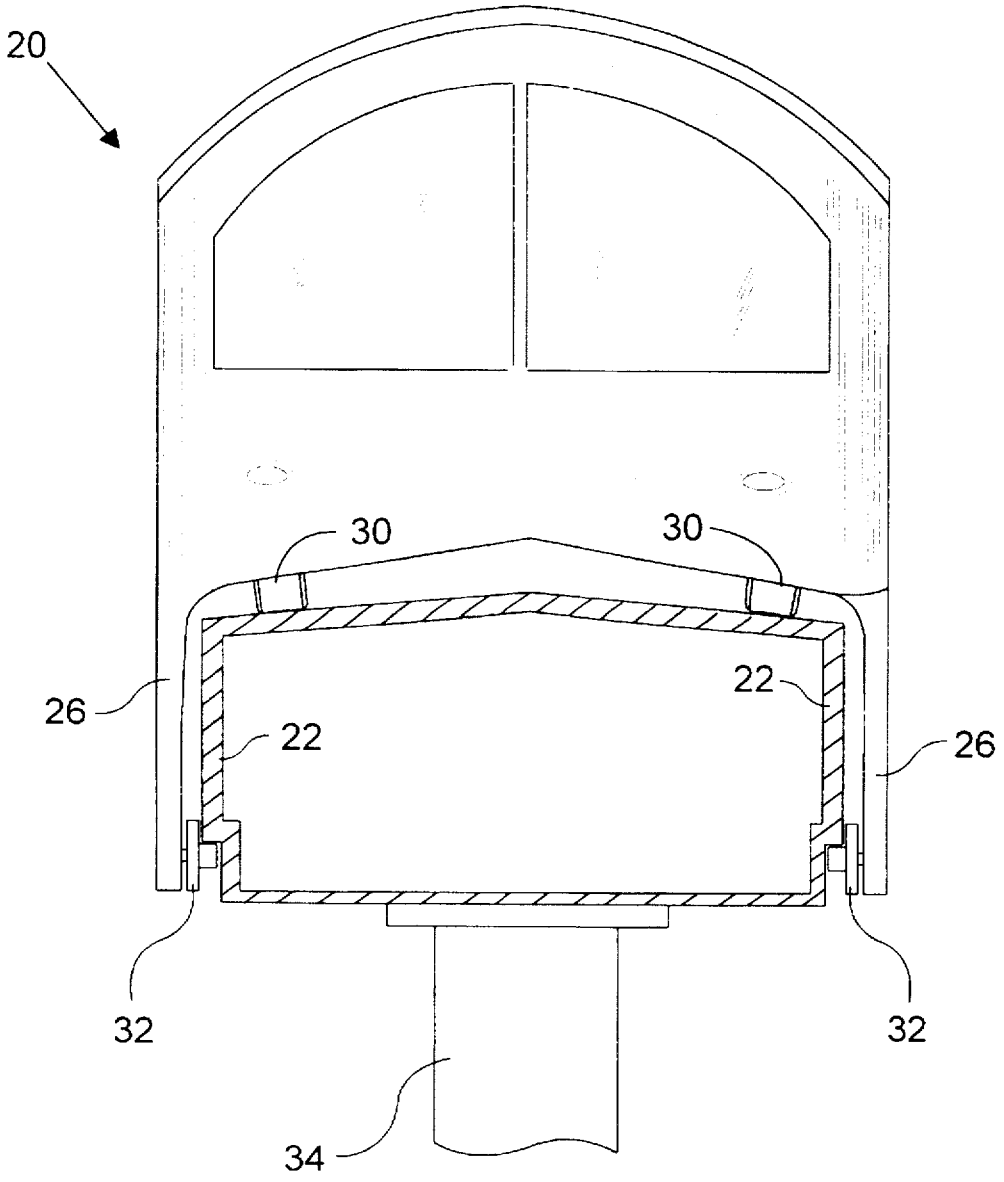
Figure 2A:
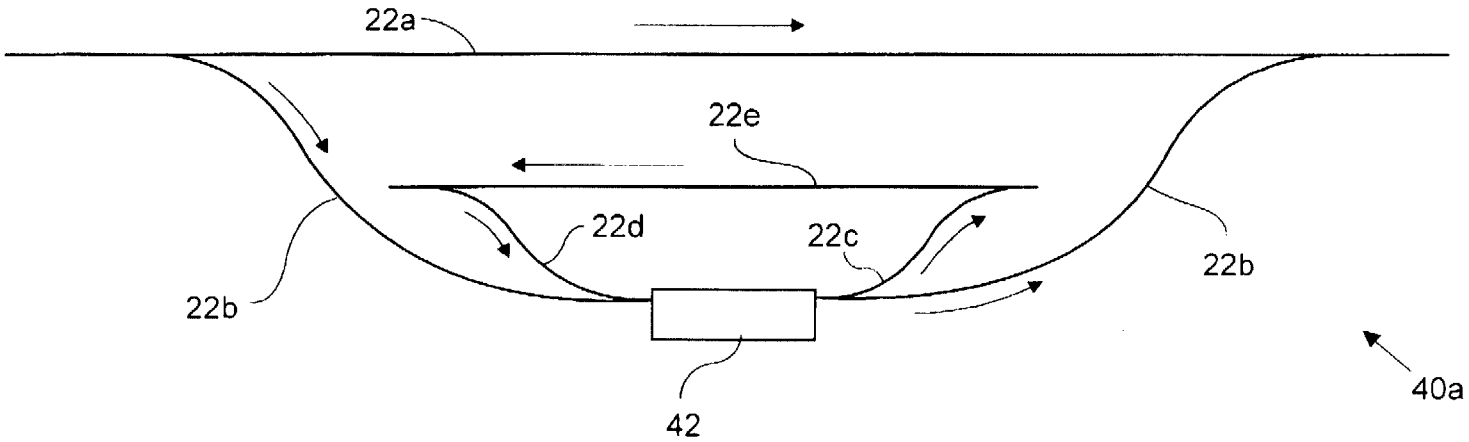
FIGS. 2A and 2B illustrate plan views of two embodiments of a passenger station arrangements and associated main, holding, and ramp tracks.
Figure 2B:
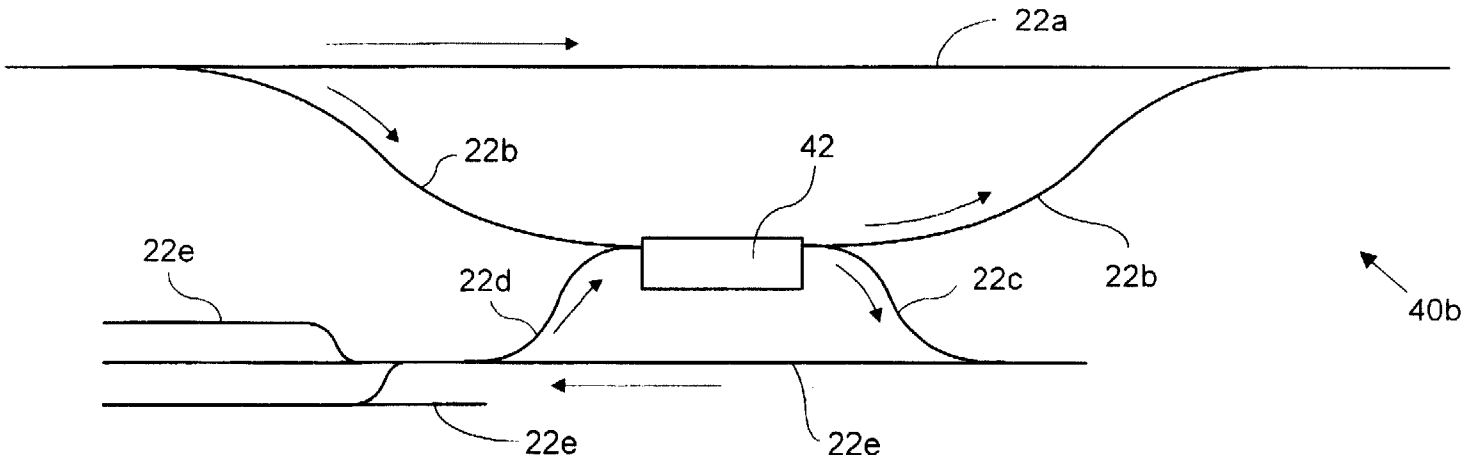
Figure 2C:
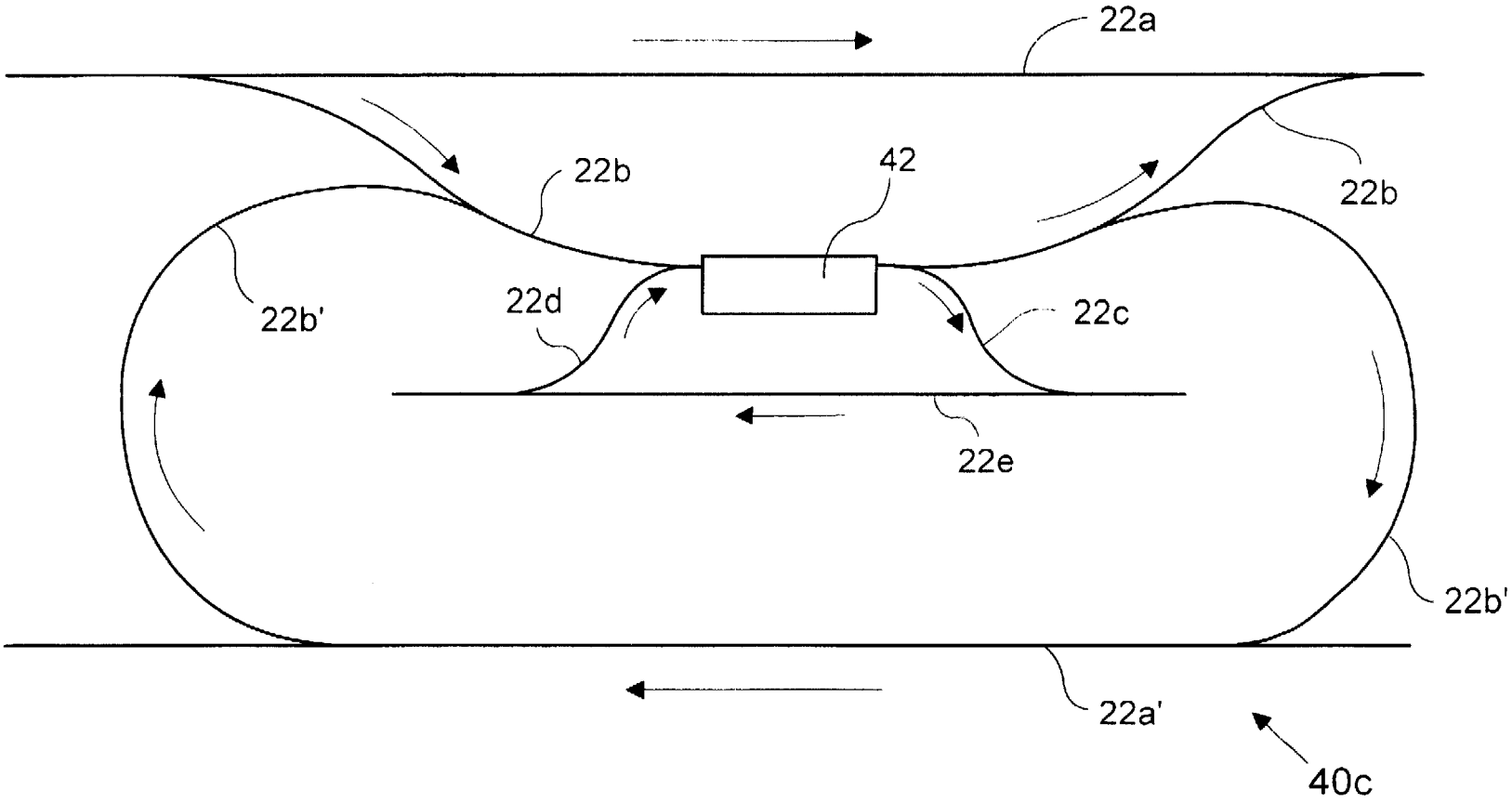
FIG. 2C is a plan view of a third passenger station arrangement to service passenger vehicles traveling on either of two main track sections (and supporting passenger transports in two different directions).

Referring now to FIGS. 1A and 1B, there is shown in accordance with the present invention an embodiment of a mass transit passenger vehicle 20. Passenger vehicle 20 is arranged to ride on track means 22, which is depicted as a monorail type track. (As illustrated in FIGS. 2A, 2B, and 2C, track means 22 provides main tracks **22*a*, ramp tracks 22*b*, 22*c*, and 22*d*, as well as holding tracks 22*e*.) The track means 22, as shown, may be provided with a triangular shaped cross section and a stepped sidewall. The stepped sidewall having an inwardly recessed lower portion associated with the holding arrangement in order to accommodate the holding wheels 32. It should be understood the cross sectional shape of the track means 22 may be triangular (as shown in FIG. 1B), rectangular (as shown in FIG. 1C), or other suitable shapes. The track means 22 may be appropriately supported by support means 34, as illustrated. A plurality of stabilizer legs 26 extend downward from the lower edge of the main passenger compartment of vehicle 20 to provide stability, especially when cornering and merging. The proximal end of the stabilizer legs 26 may be mounted in a fixed, rigid arrangement, or alternately, spring biased in the inward direction (i.e. towards the vertical center line of the track means 22) allowing a stiff and stabilizing, but slightly yielding arrangement. As illustrated in FIG. 1B the stabilizer legs 26 may be angled inward to effectively "grab" the track means 22 via holding wheels 32. Collectively, the holding wheels 32, in combination with the stabilizing legs 26 and the stepped sidewalls of the track means 22 may be termed a "holding arrangement". As shown in FIGS. 1A and 1B, the holding wheels 32 may be configured as traditional train-type vehicle wheels, or provided other known and suitable holding configurations. It should be noted, however, that holding wheels 32 do not support the weight of the vehicle, as with traditional rail-type vehicles. The full weight of the vehicle 20 is supported by wheels 30, which may be provided by known inflatable or solid core conventional tires and wheels. The configurations of FIGS. 1B and 1C will provide significant stability when cornering or merging (at junctions) at relatively high speeds. The stabilizer legs 26 provide for and maintain the centered positioning of the vehicle 20, with regard to the track means 22**, even when cornering and merging.

Referring again to FIG. 1A there is shown a vehicle with two large passenger doors **24*a*, and a storage compartment door 24*b* located near the rear of the vehicle 20. It should be understood that the arrangement of doors 24*a* and 24*b* is illustrative only, and may be provided by a number of contemplated arrangements. For example, a single door 24*a* may be provided for passengers to enter and exit the vehicle 20, and the storage compartment door 24*b* may be omitted providing an open container to hold luggage and packages. Also, the track means 22, may be provided as shown in FIG. 1A or 1B, or in other suitable configurations, including embodiments having a plurality of adjacent and parallel track means, or having multi-level (possibly stacked) track means. It should be further noted that the support means 34 may be shorter or longer that illustrated in FIGS. 1A and 1B. It is contemplated that support means 34 may not be required should it be desired to support track means 22** on the ground (i.e. at the terrain level).

The vehicles of the present invention are self propelled, and in a preferred embodiment powered by a suitable electric drive unit. Accordingly, the passenger vehicle 20 of the preferred embodiment will require a means (not shown) to couple electric power from an appropriate power source provided with the mass transit system to the vehicle. Skilled individuals can provide known arrangements to couple a suitable electric power source to vehicle 20 of the invention. In addition, a non-electric power drive unit is contemplated, for example, a steam or internal-combustion drive unit.

Referring now to FIGS. 2A and 2B, there are illustrated embodiments of passenger station arrangements **40*a* and 40*b*, respectively. Each station arrangement includes an actual passenger station (building) 42, located suitably adjacent to the main track 22*a*. The station 42 is arranged to support the pickup and drop-off of passengers. A first ramp track 22*b* enables one or more vehicles 20 to exit the main track 22*a* and pull-up to the station 42 (platform). Passengers may be dropped off and picked up, as required, at station 42. The vehicle 20 may pickup one or more new passengers, and leave the station arrangement by accelerating on ramp track 22*b* and merge back into the vehicular traffic on the main track 22*a*. If no other passengers are waiting to be transported from the station 42, a second ramp track 22*c* may be employed to place the vehicle 20 on a holding track 22*e* for use in servicing future passenger transports. When a vehicle 20 is required to transport individuals from station 42 of station arrangement 40*a*, one of the plurality of the vehicles 20 being held on the holding track 22*e*, is backed up until access to the station 42 is provided by ramp track 22*d*. Thus, ramp tracks 22*c* and 22*d*, provide for vehicles to be queued up on the holding track 22*e*, and subsequently dispatched from the holding track 22*e* by way of ramp track 22*d*** when needed for passenger transports. Should the holding track 22*e*be full, the vehicle 20 may be moved to another nearby holding track, or alternately stored at one or more area or regional holding locations (not shown). It should be noted that a key feature of the station area 40*a* of FIG. 2A, is the provision of enabling one or more vehicles to stop at the station 42, without having an affect on the velocity of the flow of traffic on the main track 22*a*. In this regard, the network of tracks supports the on-demand non-stop transport of passengers from a first (or initial) station 42 to a second (or destination) station 42.

As shown in FIG. 2A the holding track 22*e* is situated between the main track and the station building. This need not always be the case. As shown is FIG. 2B the station 42 may be positioned between the main track 22*a* and one or more the holding tracks 22*e*. It should also be noted that in locations where space is limited, a configuration of the station arrangement may be provided where the holding track 22*e* is located above or below the station 42, as required to reduce the total area required for the station arrangement construction. Further, stations that handle a large number of passengers may be provided with a plurality of holding tracks 22*e*, as shown in FIG. 2B.

Referring now to FIG. 2C, there is illustrated another embodiment of a station area 40*c*. Provided as before in FIGS. 2A and 2B, is the passenger station 42, holding track 22*e* and ramp tracks 22*b*, 22*c*, and 22*d*. The functions of these items are as discussed previously. However, the embodiment of station area 40*c* is configured to support two main track portions 22*a* and 22*a*', that provide for the flow of traffic in two different directions. The upper portion of main track 22*a* supports the flow of vehicular traffic from left to right, while the lower portion of the main track 22*a*' supports the flow of traffic from right to left. (The directions illustrated are provided as examples only.) Accordingly, in addition to the ramp track 22*b*, an additional ramp track 22*b*' is required. As before (in FIG. 2A and 2B), ramp track 22*b* of FIG. 2C enables passenger vehicles to move from the main track 22*a* to the station 42, and from the station back to the main track 22*a*. Accordingly, the lower main track section 22*a*' is connected to the passenger station 42 by ramp track 22*b*'.

As provided by FIGS. 2A, 2B and 2C, the network of interconnected track means 22 are comprised of main tracks 22*a* and holding tracks 22*e*. The main tracks of the system are provided as the main conduits for vehicle movement within the network (and between station areas such as 40*a*, 40*b* and 40*c*). The holding tracks 22*e* are provided to hold vehicles that are waiting to be dispatched to transport individuals (as passengers) from one station to another within the network. In addition, ramp means comprised of ramp tracks 22*b*, 22*c* and 22*d*, enable vehicles 20 to move between the respective station areas (e.g. 40*a* and 40*b*) and at least one portion of the main track 22*a* and the holding track 22*e* of the associated station or station arrangement. In the context of the present disclosure the terms "track" and "track means" may be used interchangeably when considering the track means 22. Further, it is contemplated that a single "loop" holding track (not shown) may be employed to replace the combination of the ramp track 22*c*, the holding track 22*e*, and the ramp track 22*d* (as illustrated in FIGS. 2A or 2C). In the case of a single loop holding track, vehicles would not have to be backed up, as they would with along the length of the holding track 22*e* of FIGS. 2A, 2B, and 2C.

Referring now to FIG. 3, there is illustrated a detailed plan view of an embodiment of the passenger station 42. This embodiment includes a station building. Each station (building) 42 may provide two separated rooms—a departure room 42*a* for individuals requiring transportation from the station 42, and an arrival room 42*b* for passengers arriving at the station 42. As a vehicle 20 enters the station 42 via ramp track 22*b*, the vehicle may stop at platform 44*b* to enable passengers to exit (if the vehicle is carrying passengers). Once arriving passengers exit the vehicle at the arrival platform 44*b*, if passengers are waiting for a pickup by a vehicle at the departure platform 44*a*, the vehicle 20 (that just arrived) would move down to the departure platform 44*a* of the departure room 42*a*. One or more individuals may then board the vehicle 20 for transport to a second station within the network. In an alternate scenario, more likely to occur during a rush hour period, passengers would be boarding vehicles that arrived earlier, while other passengers are exiting vehicles that have just arrived.

As shown in FIG. 3, the departure room 42*a* may include a number of seating units 48 and at least one station interface unit 52. The seating units 48 may be required if one or more individuals have selected a destination station that is being heavily used. If a station is at capacity, or is expected to be at capacity when one or more requested trip vehicles were to arrive, one or more of the requested transports (to that station) may be delayed. This consideration will be termed "destination concerned priority". Destination concerned priority is an important feature of the present invention. Simply put, if one or more individuals have selected a destination station which is already at or near capacity, the departure of the individuals requesting transport to that station may require a delay. Accordingly, the use of destination concerned priority prevents (or in a worst case situation nearly eliminates) station related bottlenecks and congestion caused by the overlapping and nearly simultaneous arrival of a larger number of passenger vehicles at any respective station. Even with the above described delay scenario caused by destination concerned priority, the system of the present invention can comfortably transport a high volume of individuals within a relatively short period of time due to the unobstructed flow of vehicles on the main tracks 22*a*. It should be noted that if destination concerned priority is not applied, bottlenecks may occur periodically, say during rush hour periods, and flow of vehicular traffic on the main tracks 22*a* may halt completely in one or more portions of the network.

Figure 3A:
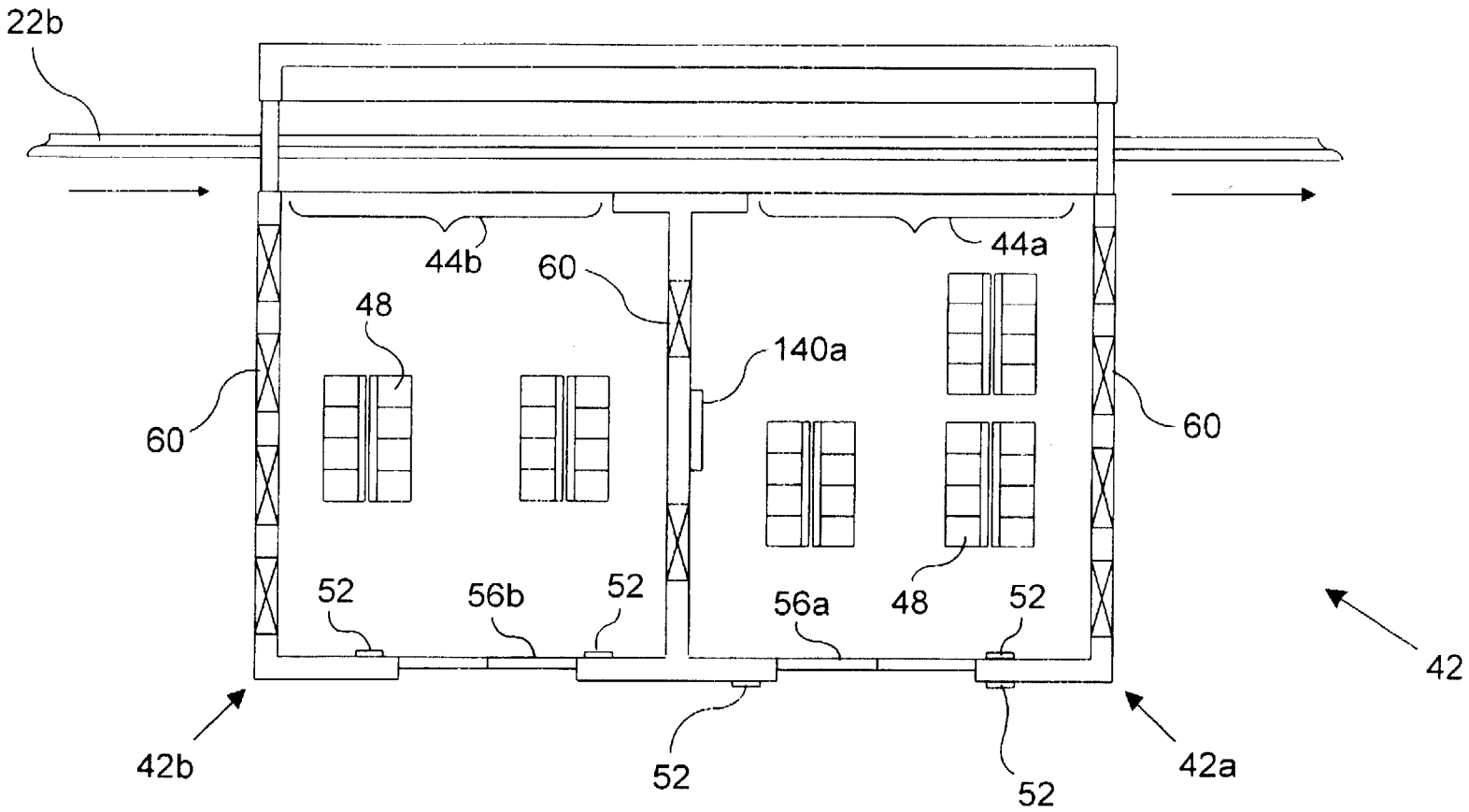
FIG. 3A illustrates a plan view of an embodiment of a passenger station building.
Figure 6:
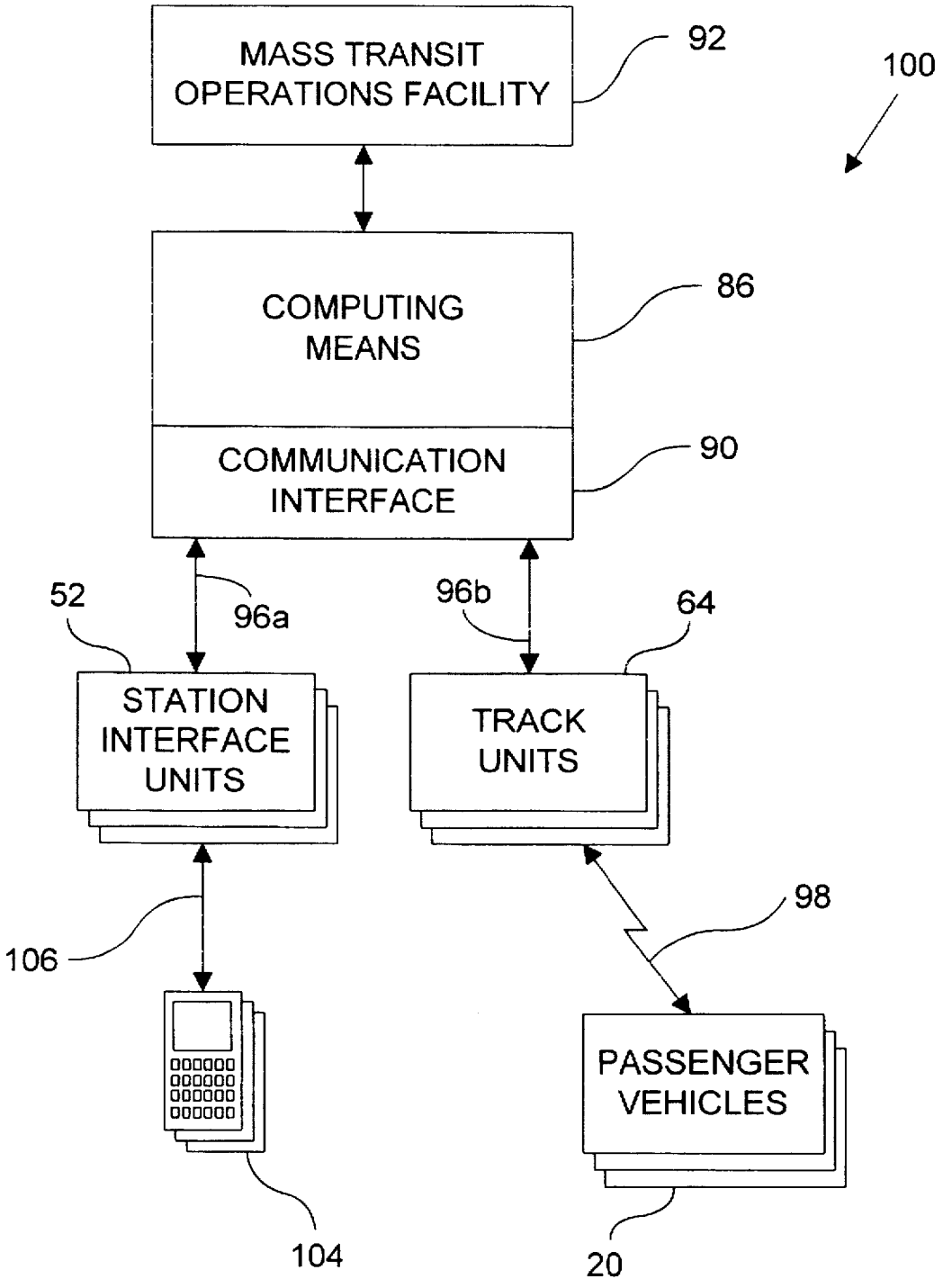
FIG. 6 is a block diagram of an embodiment of mass transit system of the invention including the major electronic components of the mass transit system.

Continuing with FIG. 3A, the station interface units 52, which may be located outside of the departure room 42*a* (on either side of the door 56*a*), are installed at each station 42 to enable information to be collected, exchanged (with a computing means 86 as shown in FIG. 6), and disseminated. For example, the station interface units 52 installed outside of the door 56*a* of station 42 enable individuals to request a pickup at the station by a vehicle 20, and to indicate other information such as the second station (i.e. the destination station) and possibly the number and status of passengers to be transported. One contemplated operational mode will require the information related to the transport of passengers be input to the "system" via the station interface unit 52, in order for an individual to gain access to the departure room 42*a*. Accordingly, once the information is provided, the door 56*a* will open and allow the perspective passengers to enter the station. Should the prospective passenger change his or her mind and not need transportation from the station 42, one of the station interface units 52 installed within the departure room 44*a*, may be used to cancel the requested pickup and enable the individual(s) to exit the station 42. The arrival rooms 42*b* of each station include a door 56*b*, possibly arranged with at least one station interface unit 52 located adjacent thereto. Arriving passengers may be required to employ the station interface unit 52 to exit the arrival room. This requirement will provide a means to verify or confirm that a party did actually utilized the system to be transported from the first station to the second station. Alternately, the door 56*b* of the arrival room 42*b* may be automatically operated by a suitable sensing means to permit arriving passengers to exit the station 42. Those skilled in the art will appreciate the variety of door operating devices known in the art. To properly inform individuals of the status of their requests for transport, and other information to be disseminated, at least one display station unit 140*a* may be included within the departure room 42*a*. A plurality of windows 60 may also be included with each station 42, as required.

It should be noted that a station or a station arrangement may be provided, for example, within a large office or factory building, and therefore not include a separate building. Accordingly the station may not include rooms to isolate the arrival and departure platform areas, but may instead provide for an arrival area and a departure area which enable access to the platform(s).

Figure 3B:
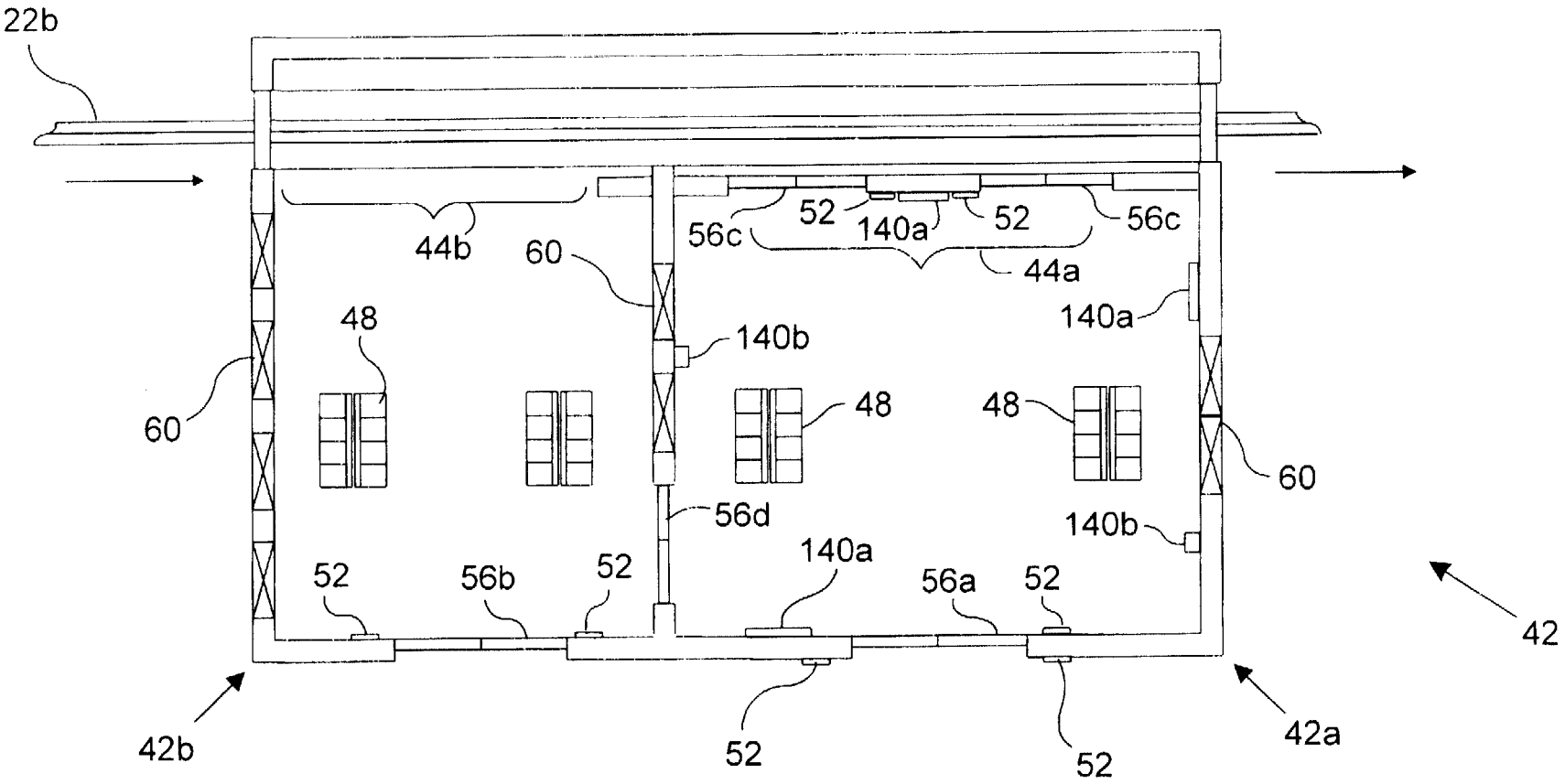
FIG. 3*b* illustrates a plan view of another embodiment of a passenger station building.

Turning now to FIG. 3B there is illustrated another embodiment of station 42. This arrangement is similar to the arrangement of FIG. 3A. Further included with this embodiment are at least one platform access door 56*c*, one or more additional station interface units 52, and a plurality of station display units 140*a*. The isolation of the track 22*b*from the departure room 42*a* by the platform access doors 56*c* (and associated wall/partition structures) provides for additional passenger safety and further helps to insure passengers board the correct passenger vehicle. For example, consider the following embodiment of an operational approach that may be utilized with the station 42 of FIG. 3B. Assume that several requests for transport have been entered via the station interface units 52. One or more station display units 140*a* will provide the status and the respective waiting times for each request. At a point in time when a vehicle arrives to provide transport for one of the pending requests, the station display unit 140*a* located between the platform access doors 56*c* of FIG. 3B (or at another suitable location), may be used to display the name of one of the individuals to be transported, the destination station name, and/or another identifying item, thereby indicating which individual(s) should board the vehicle. It is contemplated that the requesting individual may be required to use a station interface unit 52 associated with the particular platform access door 56*c* to gain access to the transporting vehicle. As will be discussed with FIGS. 10A and 10B, a "travel credit card" may be utilized by requesting individuals to exchange information with the station interface units 52, and thereby open the platform access doors 56*c* much like a key. It should be noted that the inclusion of platform access doors 56*c* is possible with passenger stations 42 regardless of whether the station has associated therewith a departure room 42*a* or a departure area. Also shown in FIG. 3B is a door 56*d*, that may be included with the various embodiments of the passenger station 42 to enable individuals to move from the arrival room to the departure room, or visa-versa.

Figure 4A:
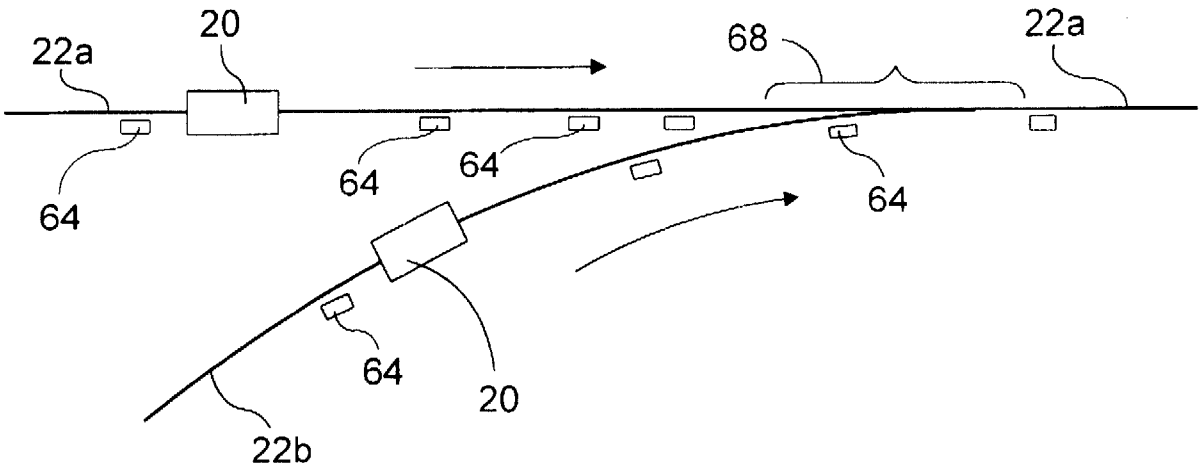
FIG. 4A depicts a top view of a portion of the network of tracks having a junction of the track means and the ramp means.

Referring now to FIG. 4A, there is illustrated a top view of a typical junction 68 of the main track 22*a* and the ramp track 22*b* (as shown providing egress from a station or station arrangement). Also shown are a plurality of track units 64 installed at spaced locations along the track means (within the network). The track units 64 are installed in locations that are substantially adjacent to one or more of the track means 22, including the main tracks 22*a*, the ramp tracks 22*b*, and possibly the holding tracks 22*e* (not shown in FIG. 4A). Each track unit 64 of the mass transit system 100 (as shown in FIG. 6) is in communication with a computing means 86 and is provided to (among other functions) monitor the position and speed of vehicular traffic on the network of tracks. An arrangement of track units 64 is contemplated wherein at least two successive track units are located with a known distance therebetween. Accordingly, as skilled individuals will appreciate, the velocity of a passing passenger vehicle 20 may be determined using the known distance in combination with the length of time it takes the vehicle 20 to move from one of the successive track units 64 to the next (or subsequent) track unit. It should be noted that it is contemplated that each track unit 64 may be configured to independently determine the speed of a respective (passing) vehicle. Each track unit 64 may further be configured to establish short duration communication links with vehicles 20 in the immediate vicinity of the respective track units 64 to support the exchange of information (including control information) between the computing means 86 and the passenger vehicles 20. The information exchanged between the computing means 86 and the passenger vehicles 20 is related to the movement and operation of the vehicles on the network of tracks. Such information may include one or more of the location of the vehicle, the speed of the vehicle, the final destination of the vehicle, a proposed and assigned route to be utilized to reach the destination, the expected arrival time at the second station, instructions to one or more respective passenger vehicles 20 to increase speed, instructions to one or more respective passenger vehicles 20 to decrease speed, to inform vehicles of upcoming junctions, and the like. The information exchanged via the track units 64, as listed above, may be control information (e.g. speed altering instructions to vehicles) or status information (e.g. the location of a vehicle). A preferred embodiment of the track units 64 will be discussed when referring to FIG. 8.

Returning to FIG. 4A, as passenger vehicles 20 approach (and/or pass) each of the track units 64 along the main track 22*a* and the ramp track 22*b*, the required communication links are established and the respective passenger vehicles 20 in the area of the junction 68 are instructed as to the upcoming junction. Therefore, as the vehicles 20 progress towards the junction 68 they are repeatedly establishing communication links, and receiving and transmitting information (including control and status information and instructions). For example, the vehicle 20 on ramp track 22*b* may be instructed to accelerate, while the vehicle 20 on the main track 22*a* may be instructed to decelerate (i.e. slow down). This would enable vehicles 20 to merge and also to ensure the vehicles "spacing gap" is appropriate to prevent passenger vehicles 20 from getting too close to one another, or colliding with one another.

Figure 4B:
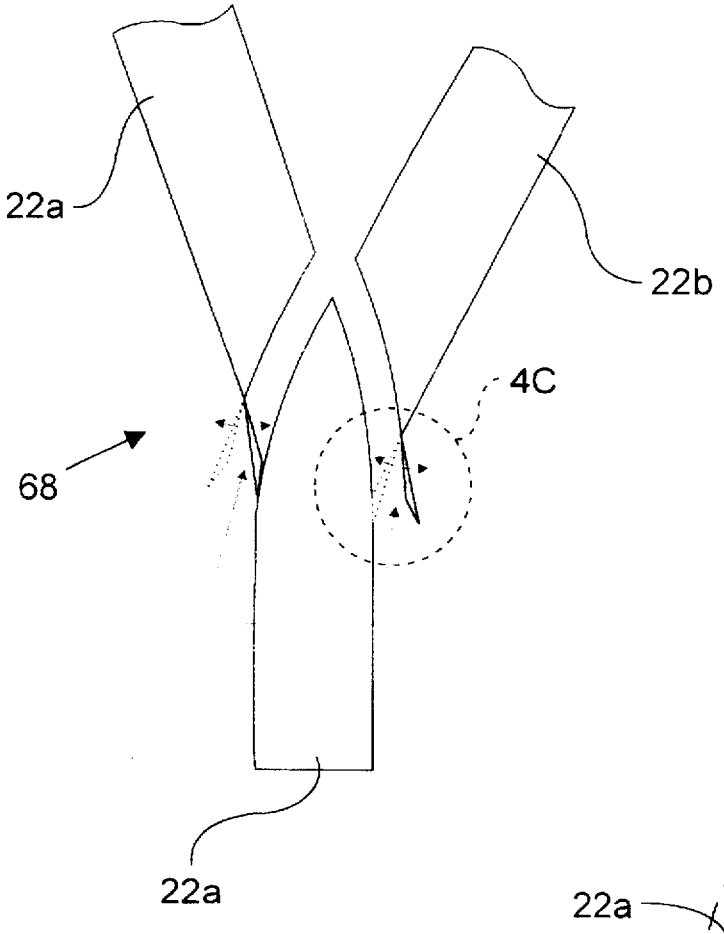
FIG. 4B shows a detailed top view of a junction arrangement of the present invention, while FIG. 4C provides an enlarged view of an embodiment of a steering plate included with the arrangement of FIG. 4B.
Figure 4C:
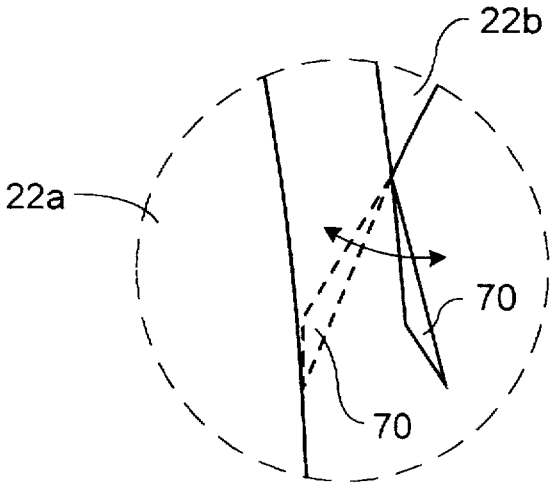

Referring now to FIG. 4B, there is shown a top view of an embodiment of the junction 68 of the present invention. Shown are three track sections, two are provided by the main track 22*a*, and a third is provided by the ramp track 22*b*. The arrangement illustrated in FIGS. 4B and 4C employs a plurality of hinged steering plates 70, which are suitably mounted to a track means 22 so that the plates 70 may be positioned in either a first position (shown with solid lines) or a second position (shown with dotted lines). FIG. 4C provides an enlarged view of the embodiment of one of the steering plates of the arrangement of FIG. 4B. It should be noted that each plurality of steering plates 70 provided with each junction 68, are coupled so that the plates move between the first position and the second position, or visa-versa, simultaneously and in unison. The switching plate arrangement of FIGS. 4A and 4B may be termed a "track selection means", and employed at each junction 68 to direct vehicles to one of a plurality of tracks connected at the junction location. Further, in a preferred embodiment the track selection means at the junction 68 would be installed in the vicinity of, and responsive to, one of the plurality of track units 64. Therefore, control information to control a junction 68 would be transmitted to the associated track unit 64, by a suitable computing means. As shown in FIG. 4B a passenger vehicle passing through the junction 68 (with the steering plates in the solid line position) would be steered along the main track 22*a*, regardless of the direction the vehicle 20 is traveling. Similarly, should the steering plates 70 be positioned in the second position (i.e. the position indicated by dotted lines) a passenger vehicle would be steered to/from the ramp track 22*b*. It should be noted that the junction 68, employing the steering plates 70 (as a track selection means) is intended to be illustrative only, and other arrangements are contemplated as being within the scope of the invention. Those skilled in the art can provide yet other suitable arrangements for junction 68. It must also be understood that one or more nearby track units 64 in the immediate vicinity of each junction location would be employed to control the junction 68 (and the steering plates 70) as required to maintain the required flow of vehicular traffic through each junction location provided with the mass transit system 100.

The junction of FIGS. 4A, 4B and 4C, depicts a main track 22*a*merging with a ramp track 22*b*. It should be understood that other combinations of track means 22 may be used to form a junction 68. For example, a junction may be formed by two or more sections of the main track 22*a*, or as shown in FIG. 2B a junction of ramp track 22*c* and the holding track 22*e*. Other arrangements are contemplated as being within the scope of the present invention as well.

Figure 5A:
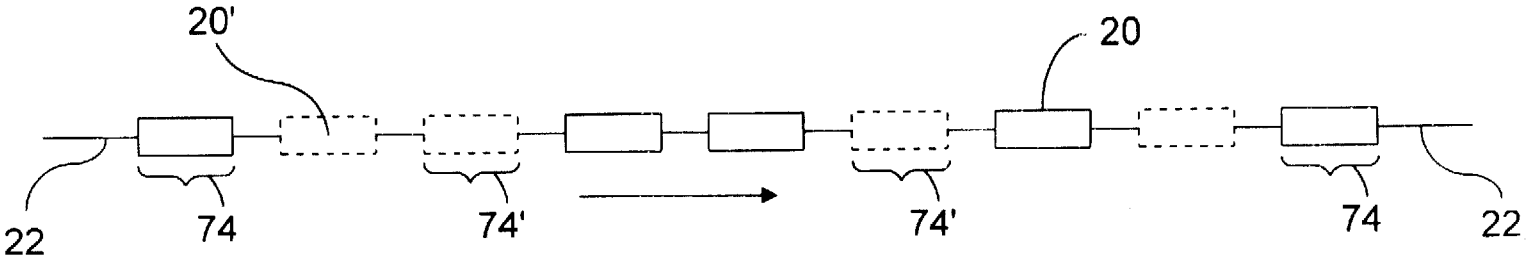
FIGS. 5A and 5B illustrate the timing and alignment required at junction locations to safely merge vehicles.
Figure 5B:
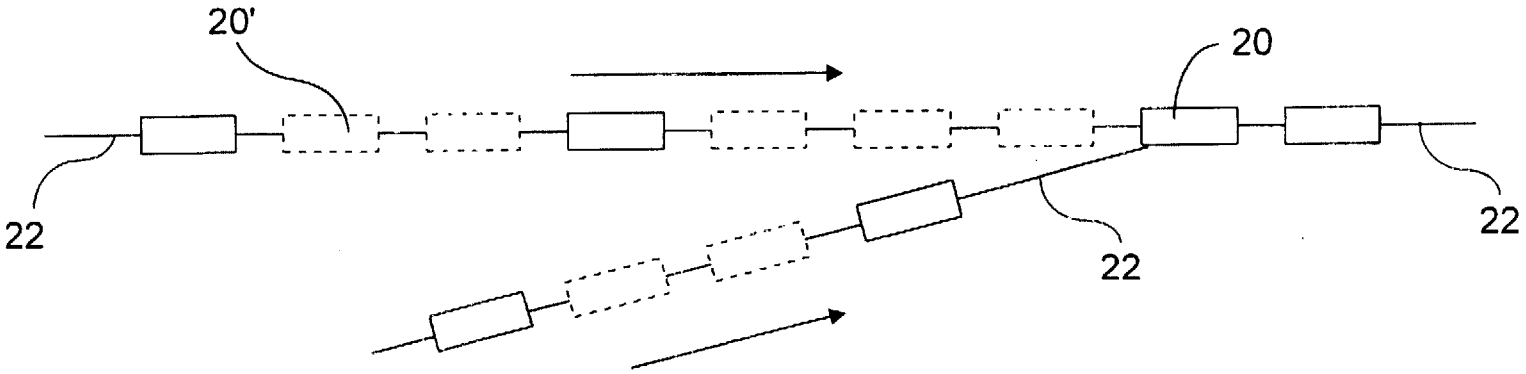

Referring now to FIG. 5A and 5B, there is illustrated the timing and alignment required within the network of tracks and in particular, at junctions such as junction 68. FIG. 5A provides a plurality of passenger vehicle "slots" 74/74'. Each slot may be occupied by a vehicle 20 (slot 74), or be unoccupied and empty (slot 74'), indicating a location where a merging vehicle may be positioned at an upcoming junction 68. The slots will be collectively referred to as slots 74/74' when appropriate. It is important to note that slots 74/74' are moving along (i.e. traversing) the track means 22, and must be aligned with merging vehicles 20 at junctions 68 of the track means 22 to avoid collisions. In a preferred embodiment of the mass transit system 100, the slots 74/74' are monitored by track units 64 (not shown in FIGS. 5A and 5B), and the status (of each slot) transmitted to a (remote) computing means of the system 100. A detailed discussion of the computing means 86 will be provided when referring to FIG. 6. The monitoring of the slots 74/74' will enable the empty slots 74' on one section of the track means 22 to be aligned with a merging passenger vehicle 20, on a second section of the track means 22. The alignment of slots 74' and passenger vehicles 20 is accomplished by issuing commands in the form of control information (to accelerate or decelerate) to the appropriate vehicles on each section of the track means 22. Accordingly, the issued control information will result in proper merging of passenger vehicles 20 so as to enable the vehicles on a first track section to transfer to a second track section and be placed and positioned in a previously empty slot 74'. It should be understood that the necessary commands for speed adjustments of vehicles, so as to maintain the slots 74/74', may be issued via the track units 64, wherein each respective track unit 64 establishes a short duration wireless communication link to issue the appropriate commands to the required vehicle(s) after sensing the respective positions of a plurality of passenger vehicles traversing the section of the track means 22. Alternately, the inclusion of suitable means (e.g., one or more modules and units) within the passenger vehicles 20 may provide for the maintaining of the slots 74/74' by each of the passenger vehicles 20 appropriately altering their speed. For example, if a vehicle is equipped with a sensing means and determines it is too close to another vehicle, the vehicle may appropriately adjust its speed. Therefore, the mechanism employed to maintain the slots may be provided by several contemplated arrangements, including vehicle borne units and stationary (track side) units.

To properly understand the present invention, including the preferred features and overall functionality associated therewith, a clear understanding of the overall architecture of the system is required. Although a variety of embodiments of the components of the system are possible, the preferred embodiments for the entire system all include a plurality of common well defined items (i.e. modules, units, or components). Accordingly, a discussion of embodiments of the mass transit system 100 of FIG. 6 and the embodiments of the components to realize such a system, will be provided next. Subsequently, the function and operation of the system will be further discussed.

Turning now to FIG. 6, there is provided a high level block diagram of the mass transit system 100 of the invention. An important component of the present invention is a computing means 86. The computing means 86 is included to control and coordinate the activities of the mass transit system 100. As such, the computing means 86 will process the requests from individuals requesting transport from a first passenger station 42 to a second station (within the network of tracks), assist in the control of the flow of traffic within the network, request passenger vehicles be moved to and from the holding tracks 22*e*, determine "routing decisions", as well as other computing and decision related activities required for the system 100 to function. The computing means 86 will also be able to determine (or look-up) all possible routes from each possible first station to each possible second station. This information may be transmitted to track units 64 or vehicles 20 as required to support the operation of the system 100. It must be understood that computing means 86 may be realized by one large centralized computer means, such as a mainframe or mainframe cluster, or alternately, as a distributed computer system, possibly with a hierarchical structure. In a distributed and hierarchical embodiment of the computing means 86, a plurality of the smaller computing elements (not shown) may be employed to generate the computing power required. The computing elements may be provided as a local or nearby computer system (in the general vicinity of a plurality of the track units 64 and passenger stations 42) and may be incorporated within a modified embodiment of one or more of the passenger stations 42. Each local computer system may then be linked to a remote and centralized computing system/facility, which may in turn be linked to other higher level computing means. Therefore, the computing means 86 of FIG. 6, may actually be comprised of a number of distributed computer systems connected to one or more central "higher level" computer systems. The interconnection of the computing means 86, whether implemented by a single computer or a hierarchically organized plurality of computers, to the other required units, such as the track units 64 and the station interface units 52, may be provided by currently available technology. In particular the advent of high speed packet switched data networks, such as asynchronous transfer mode (ATM) systems, are generally capable of supporting the communications needs of the system of the present invention. In addition, should the amount of information being exchanged between the various components of the system 100 reach the maximum capacity of the computing means 86 and associated communication channels, a prioritization scheme may be employed to discontinue certain activities provided by the system 100. At the point in time when the activities drop below the maximum capacity, the discontinued features may be reinstated. Advanced technologies, now readily available to support wireless local area and wide area data networking include spread-spectrum, cellular, and satellite based techniques. However, any suitable hardwired or wireless communication channel that will provide sufficient bandwidth to adequately support the required information exchanges of the systems 100 is contemplated as being within the scope of the present invention.

Returning to FIG. 6, the computing means 86 is linked to a mass transit operations facility 92, which will enable operators to oversee and monitor the operation of the system 100. For simplicity the mass transit operations facility 92 is shown as a single block/location. However, much as the computing means 86 may be provided by a plurality of computers, the mass transit operations facility 92 may actually be comprised of facilities at a plurality of locations. The computing means 86 is suitably coupled to the plurality of station interface units 52 and the plurality of track units 64 via a communication interface 90. (It can be noted that the communication interface 90 may itself be provided by devices having additional computers embedded therein.) Therefore, all information exchanged between the computing means 86 and either the station interface units 52 and/or the track units 64, will be supported by the communication interface 90 and the associated communication links **96*a* and 96*b***, respectively.

As shown in FIG. 6, the track units 64 communicate with the passenger vehicles 20 via a wireless communication link 98. The information exchanged with the passenger vehicles 20 may include information that has originated at the track units 64, or the passenger vehicles 20, and must be passed on to the computing means 86 for processing. Similarly, the information exchanged may have originated at the computing means 86 and must be delivered to one or more respective track units 64 or station interface units 52. Regardless of the actual origin and destination of the information to be exchanged, communication interface 90, along with the communication links **96*a*, 96*b*, and 98 (and possibly others) may be employed to support the needed information exchanges. However, skilled individuals will be able to supply a number of other arrangements and architectures that may be employed to support the information exchanges required for the operation of mass transit system 100**.

Also shown in FIG. 6, is a travel credit card 104 that may be included with the mass transit system 100 to enable individuals to supply information to the system related to passenger transports. The information may be input to the travel credit card, and "read" by the station interface unit 52. The information regarding the transport, which will be transmitted to the computing means 86 to process and schedule the transport request, may include items such as the destination station, and the number and status of the passengers. The term "status" as applied to passengers could indicate if one or more passengers are handicapped, injured, and so on. The passenger status information may be utilized to prioritize requests for transport.

It must be understood the architecture of FIG. 6 is one of many that may be provided to embody the mass transit system 100 of the invention. For example, the station interface units 52 and the track units 64 may be coupled to the computing means 86 by a single communication channel 96 (not shown) instead of a plurality of links including **96*a* and 96*b*. Further, the station interface units may be coupled to the computing means on a separate lower bandwidth communication link, while the track units 64**, which will generally require much higher bandwidth data channel(s), may communicate over a plurality of hierarchically organized communication links, including high speed optical links. Those skilled in the art will appreciate the number and variety of communication means that may be employed to support the exchanges of information between the various units of the invention.

Figure 7:
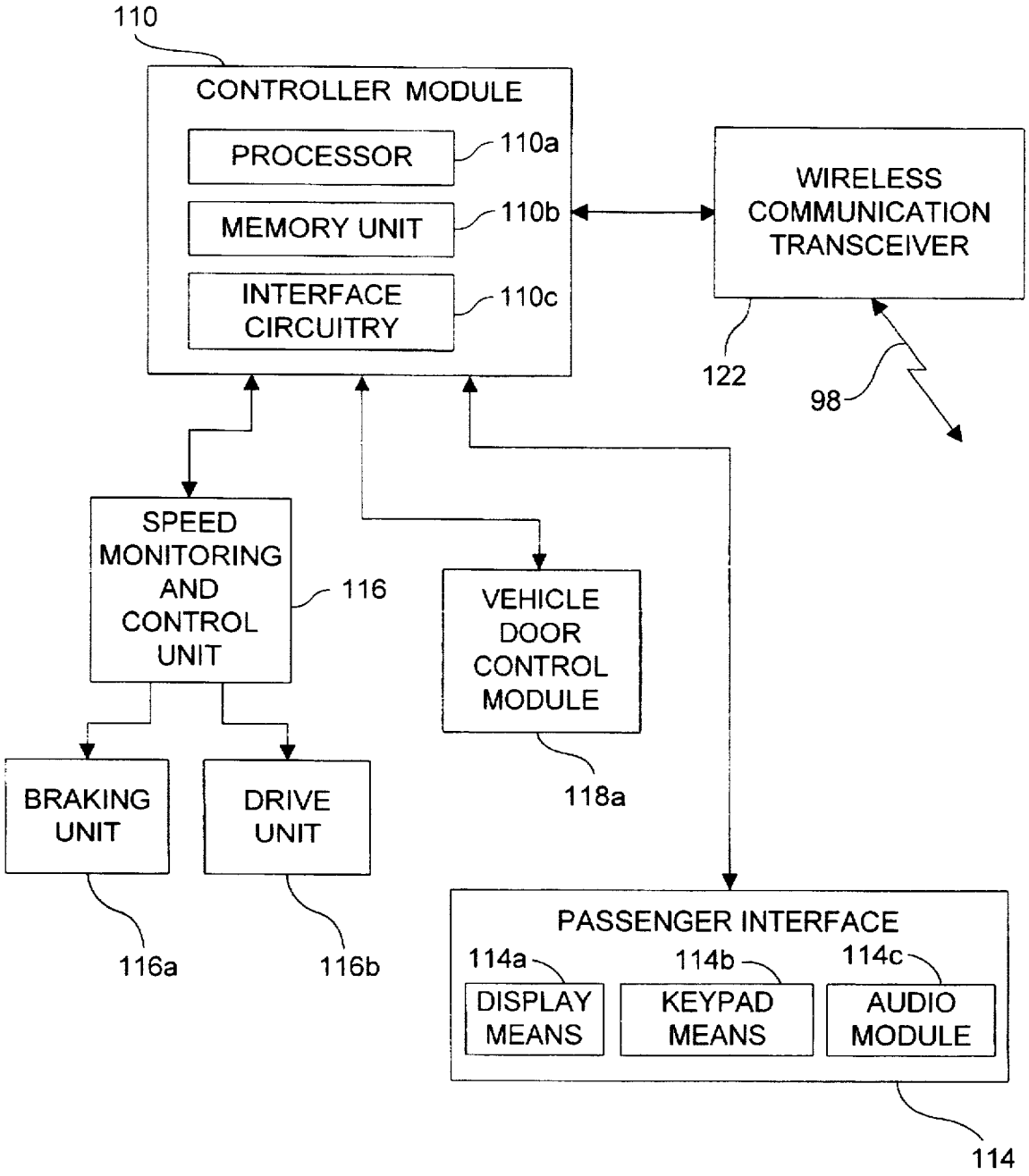
FIG. 7 is a partial block diagram of the system included in the passenger vehicle of FIGS. 1A, 1B and 1C.

Referring now to FIG. 7 there is provided a partial block diagram of an embodiment of the passenger vehicle 20. The partial system diagram includes components required to support the operation of the mass transit system 100, as well as other components that are associated with (or controlled by) the system. A controller module 110 is included to provide the necessary control, computing, and communication functions to support the overall operation of the vehicle 20. The controller module is comprised of a processor **110*a*, a memory unit 110*b*, and required interface circuitry 110*c*. The processor 110*a* is arranged to execute an embedded application program to define the functional characteristics of the passenger vehicle 20. This program may be stored in any suitable non-volatile memory. Accordingly, memory unit 110*b* may include one or more non-volatile memory devices, as well as required volatile memory devices to support the operation of controller module 110. A number of available off-the-shelf devices such as EPROM, EEPROM, flash memory, or other suitable devices/technologies may be employed. Similarly, the processor 110*a* may be provided by any suitable commercially available microprocessor or microcontroller. Such devices are well known in the art. The controller module 110 further includes any required interface circuitry 110*c*. The interface circuitry 110*c* is provided to operatively couple the various vehicle components and subsystems to the controller module, as required. It should be noted that all of, or a portion of, the required interface circuitry 110*c* may be provided by the particular microprocessor or microcontroller selected for use in the passenger vehicle 20. The controller module 110, including processor 110*a*, memory unit 110*b*, and interface circuitry 110*c*** may be generally termed an embedded computing unit.

Also included in FIG. 7 is a passenger interface 114 included to provide information related to the operation of the passenger vehicle 20. The information is provided to passengers via the passenger interface 114 that is operatively coupled to the controller module 110. The passenger interface unit may indicate the speed of the vehicle, the estimated time of arrival (ETA) the vehicle 20 is expected to arrive at the destination station 42, and the current time of day. In a preferred embodiment the passenger interface 114 may include a display means **114*a* such as an LCD or CRT display, a simple keypad means 114*b* to enable passengers to provide commands to the controller module 114, and an audio module 114*c* including one or more audio interface components such as a sounder, a buzzer, and a speaker. The information provided to the passengers of vehicle 20 may be issued as displayed information (e.g. text and graphics) or by way of appropriate audio messages. An important aspect to the operation of the passenger vehicle 20, and the mass transit system 100 in general, is the computer control of the vehicles 20 in operation on the network of tracks. For example, when a vehicle 20 is scheduled to depart a station 42, the computing means 86 may issue one or more commands to the controller module 110 of the vehicle 20. The commands received and processed by the controller module 110 may result in the issuing of audio messages, the closing of the doors (via the vehicle door control module 118***a*) of the vehicle 20 and the controlled acceleration in order to merge with existing vehicular traffic present on the main track 22*a*. To properly control the acceleration and deceleration of the vehicle 20, a speed monitoring and control unit 116 is provided that monitors the speed of the vehicle 20, and also controls a braking unit 116*a* and a drive unit 116*b*. The speed monitoring and control unit 116, the braking unit 116*a*, and the drive unit 116*b* are well known in the art and may be provided by skilled individuals.

FIG. 7 also provides a wireless communication transceiver 122, which is operatively coupled to the controller module 110. The wireless communication transceiver 122 is configured to establish periodic short duration communication links via communication link 98. When established, the communication link 98 enables the exchange of information between the vehicle 20 and one or more track units 64. Each communication link 98 is established with track units 64 in the immediate vicinity of the passenger vehicle 20. The term "immediate vicinity" is defined as within 15 meters of the respective track units 64 (with which a communication link is to be established). A function contemplated that may possibly be provided by the controller module 110 of FIG. 7, is that of determining and transmitting control information to series the junctions 68 along a predetermined route in order to correctly guide the respective vehicle to the required destination station. Should it be necessary to "off-load" this work from the controller module 110, additional merging and diverging management units (not shown) may be provided to handle the control of merging and diverging at a sequence of junctions 68 along the route being traversed. It should also be noted that it will be the responsibility of each vehicle 20 traversing the main tracks 22*a* to maintain one or more equivalent slot distances between the vehicle preceding the vehicle 20, and one or more slot distances between the vehicle following the vehicle 20. Systems are known in the art that provide for safely and automatically controlling the distance between vehicles. For example, U.S. Pat. No. 5,388,789 to Ruderhausen provides such a system.

Figure 8:
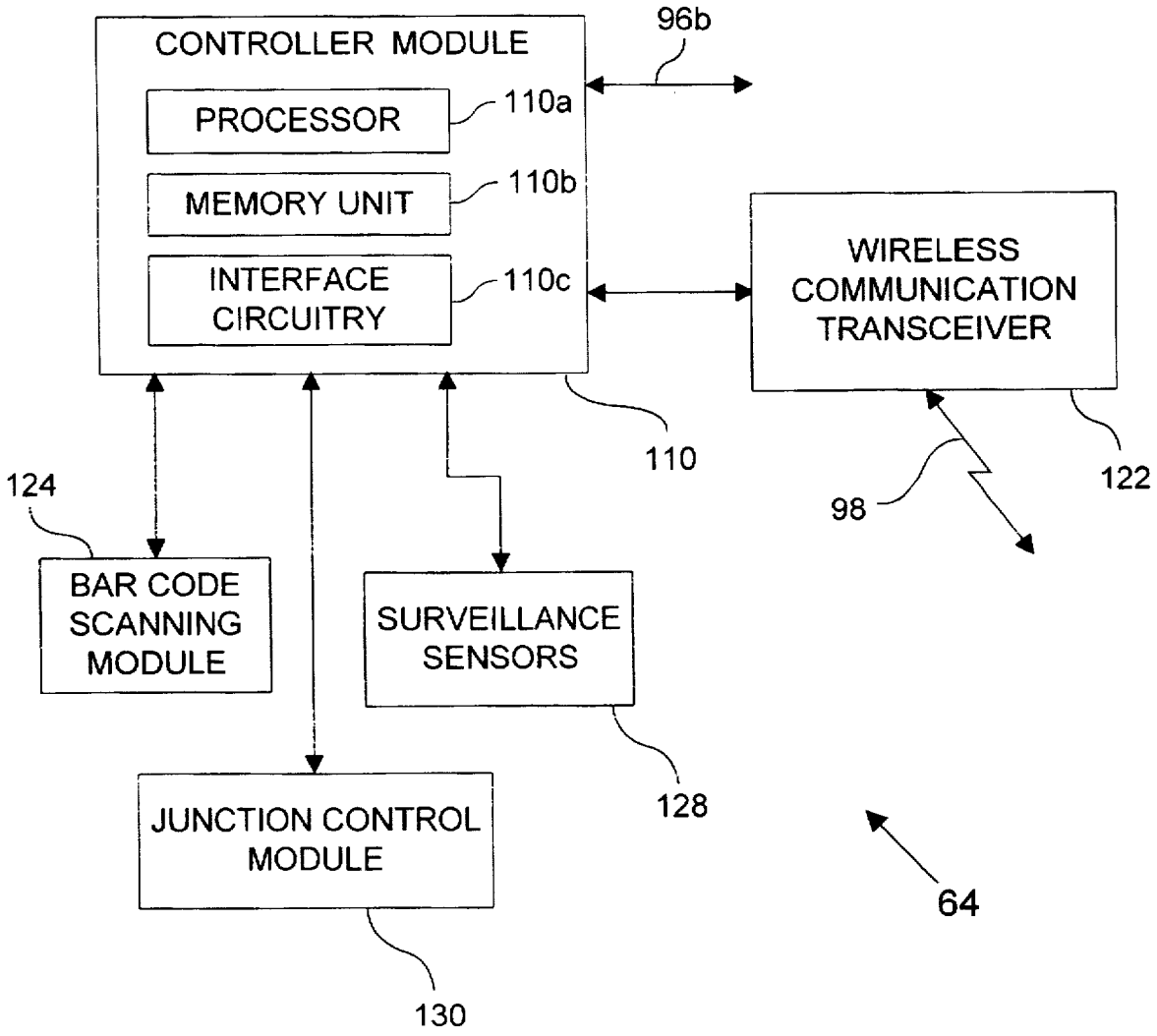
FIG. 8 shows a block diagram of the track units installed on the track means and ramp means.

Referring now to FIG. 8, there is provided an embodiment of a track unit 64. The controller module 110 provides the equivalent functions of the controller module 110 of FIG. 7. However, it must be understood that the embedded application program for the track units 64, stored in memory unit 110*b* and executed by processor 110*a*, will of course differ from the application program of FIG. 7. That is, the functional characteristics of the passenger vehicle 20 defined by the memory unit 110*b* of FIG. 7 will differ from the functional characteristics required for the track units 64. Also included with each track unit 64 is a wireless communication transceiver 122, which is functionally equivalent to the wireless communication transceiver 122 of FIG. 7. The track units 64 are further configured with a bar code scanning module 124, one or more surveillance sensors 128, and may additionally include a junction control module 130. The scanning module 124 is arranged to scan each passenger vehicle 20 outfitted with a suitably positioned bar code indicia 28 (as shown in FIG. 1A) as the respective vehicles 20 pass track units 64. (Note the bar code indicia in a preferred embodiment would be located on the "inside" of the stabilizing leg 26 where it may be easily scanned.) The scanned bar code indicia, which provide unique vehicle identification numbers for each scanned vehicle, are transmitted to the computing means 86 for processing. The use of unique bar code indicia 28 to identify each passing vehicle enables the computing means 86 to monitor the location of each vehicle traveling within the network without the need for an information exchange between the respective vehicles and the track units 64. In addition, should there be a malfunction in one or more of the on-board electronic systems of the passenger vehicle 20, resulting for example in the failure of the wireless communication transceiver 122, the system may still be able to track the vehicle as it moves along the track means 22 of the invention. The surveillance sensors 128 may be included with the track units to further enable the monitoring of passing passenger vehicles 20. The surveillance sensors may be provided to monitor vehicle speed, vehicle acceleration, and other operating parameters of the passenger vehicles 20. Another important component included with a plurality of the track units 64 is the junction control module 130. The track units 64 that include the junction control module 130 are positioned near junctions 68 and are provided to control the traffic flow through the associated junction 68. The actual settings for each junction 68, which will determine the particular track means 22 that respective vehicles will traverse (and ultimately direct vehicles to the respective destination passenger stations), will be determined by the computing means 86 and transmitted to the appropriate track units 68 by way of the communication link 96*b*. Those skilled in the art will appreciate that the embodiment of FIG. 8 is one of many that may be employed to provide the required functionality of the track units 64. Therefore, the embodiment of FIG. 8 is intended to be illustrative only, and generally convey the required functionality the track units 64.

Figure 9:
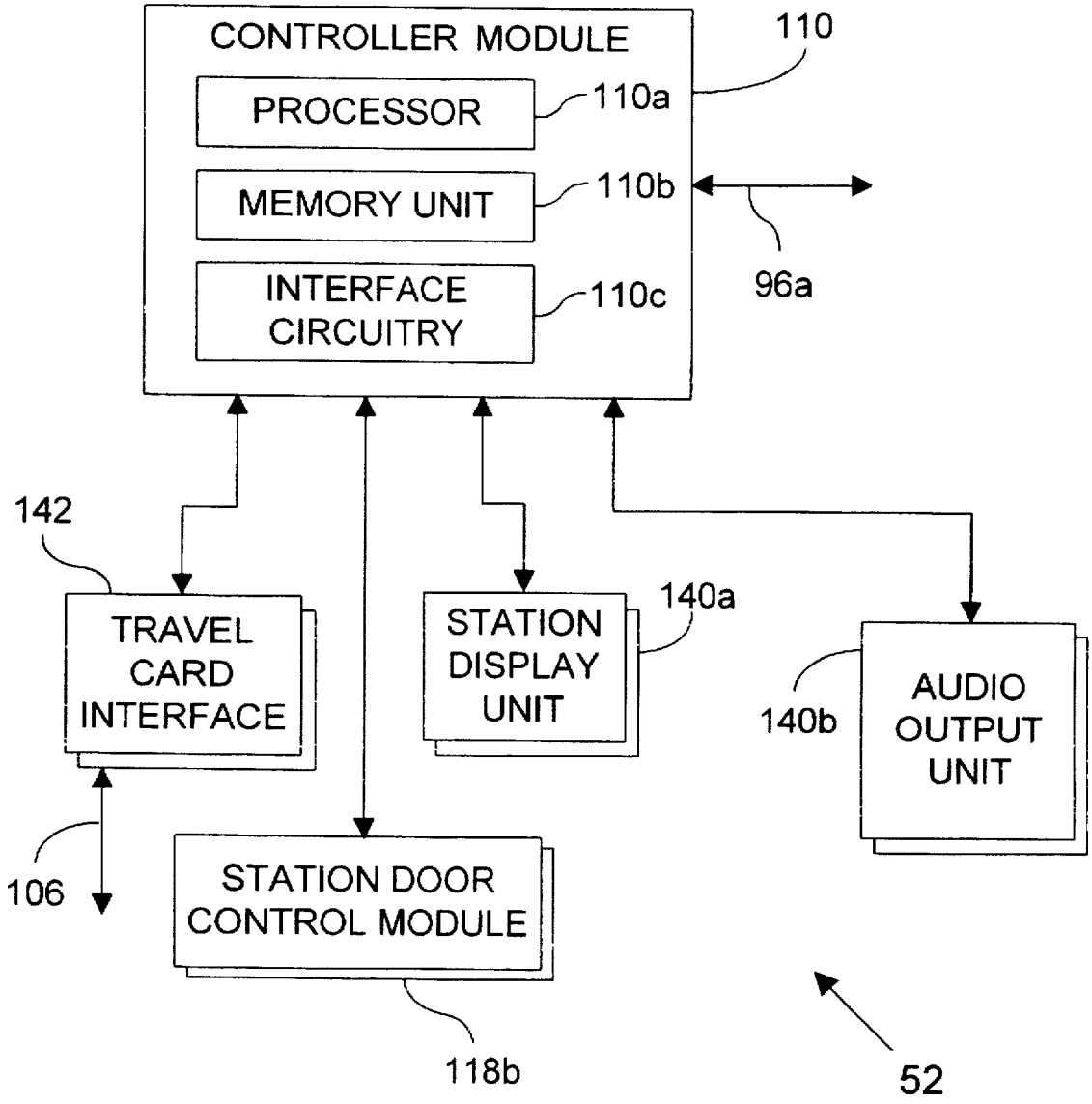
FIG. 9 is a block diagram of an embodiment of a station interface unit of the invention.

Turning now to FIG. 9, an embodiment of a block diagram of a station interface unit 52 is shown. The station interface unit 52 is included with the mass transit system 100 to enable individuals to request a pickup at the first passenger station 42 by a passenger vehicle 20, and to indicate other information including at least one of the second station to be transported to and the number and status of passengers to be transported. The station interface units 52 may further include units or modules, such as a station display unit 140*a* and an audio output unit 140*b*, to indicate appropriate information including information related to one or more requests for transport from the associated passenger station 42. As with the track unit 64 of FIG. 8 and the vehicle block diagram of FIG. 7, the controller module 110 is included to provide the necessary control, computing, and communication functions necessary to support the operation of the station interface unit 52.

The station interface unit 52 of FIG. 9, further includes a travel card interface 142 that enables the exchange of information between a travel credit card 104 and the station interface unit 52. A link 106, which is established to support the exchange of the information, may be provided by any suitable coupling means including an optical means (e.g. infrared) or other suitable and know means. In a preferred embodiment link 106 of the travel card interface 142 would be provided by an infrared interface means (not shown). Other coupling means, such as magnetic and mechanical means, are contemplated as being within the scope of the invention disclosed herein. Those skilled in the art can supply a number of suitable coupling arrangements to establish link 106. Each station interface unit 52 may further include a station door control module 118*b*. The station door control module 118*b* may be included to require individuals to employ their travel credit card 104 to enter, and possible exit, the passenger station 42. This would restrict access to passenger stations 42 and generally increase security and safety at the station.

It should be understood that the embodiment of the station interface unit 52 supplied in FIG. 3 and 9 is one of many possible. In particular, the arrangement implied by FIG. 3 showing a plurality of station interface units 52 installed at various locations within the station 42, need not be configured as shown. For example, an alternate configuration contemplated is to provide a single "main" station interface unit 52 that is configured with a plurality of "auxiliary" components including one or more station display units 140*a*, travel card interfaces 142, and so on. With such an arrangement, a single communication link 96*a* would be required for each passenger station 42, and may as such yield a preferred embodiment of the station interface unit 52.

Figure 10A:
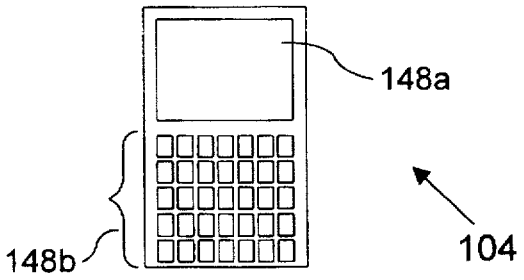
FIGS. 10A and 10B provide an embodiment of a travel credit card for use with the station interface units.
Figure 10B:
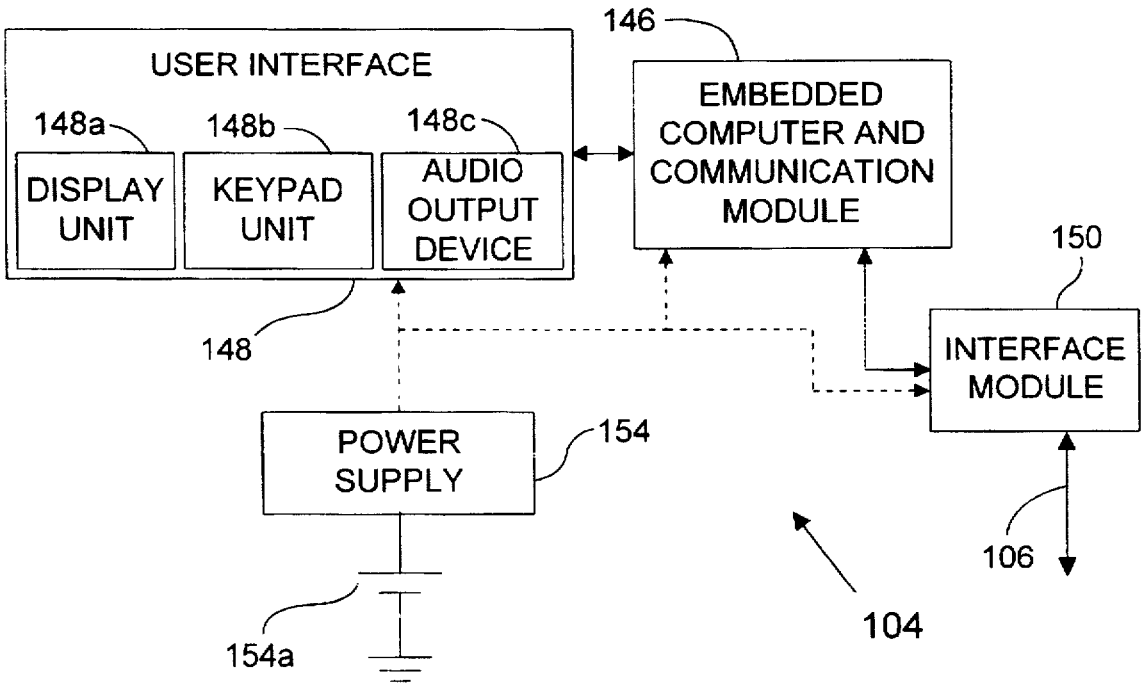

Referring now to FIGS. 10A and 10B, illustrated is an embodiment of the travel credit card 104. As shown an embedded computer and communication module 146 is included to provide the necessary computing and communication functions, and to generally provide the overall functionality of the travel credit card. The embedded computer and communication module 146 would include items such as a processor, primary and secondary memory devices, input/output (I/O) devices, and the interface and communication circuitry required to support the operation of the module 146. An interface module 150 is functionally coupled to the embedded computer and communication module 146 and is provided to support the link 106. Recall link 106 is established to exchange information between the travel credit card 104 and the station interface units 52. Further included with the travel credit card 104 is a user interface 148, that may include a display 148*a* and a keypad means 148*b* (as shown in FIG. 10A). The user interface 148 is provided to enable individuals to input information into, and to receive information from, the travel credit card 104. This information will ultimately be exchanged with the station interface unit 52 and the mass transit system 100. As the travel credit card 104 is contemplated as being a hand held portable item, a power supply 154 including a battery source 154*a*, is included. Skilled individuals can provide a number of well known arrangements to embody power supply 154. It should be noted that the mass transit system 100 of the present invention may or may not include the use of the travel credit card 104. If the travel credit card 104 is not employed by all passengers using the system 100, an appropriate human interface (not shown) would be included with each station interface unit 52 to enable the "direct" exchange of information between the station interface unit 52 and perspective passengers. The human interface would typically include a display means and a keypad means.

Figure 11:
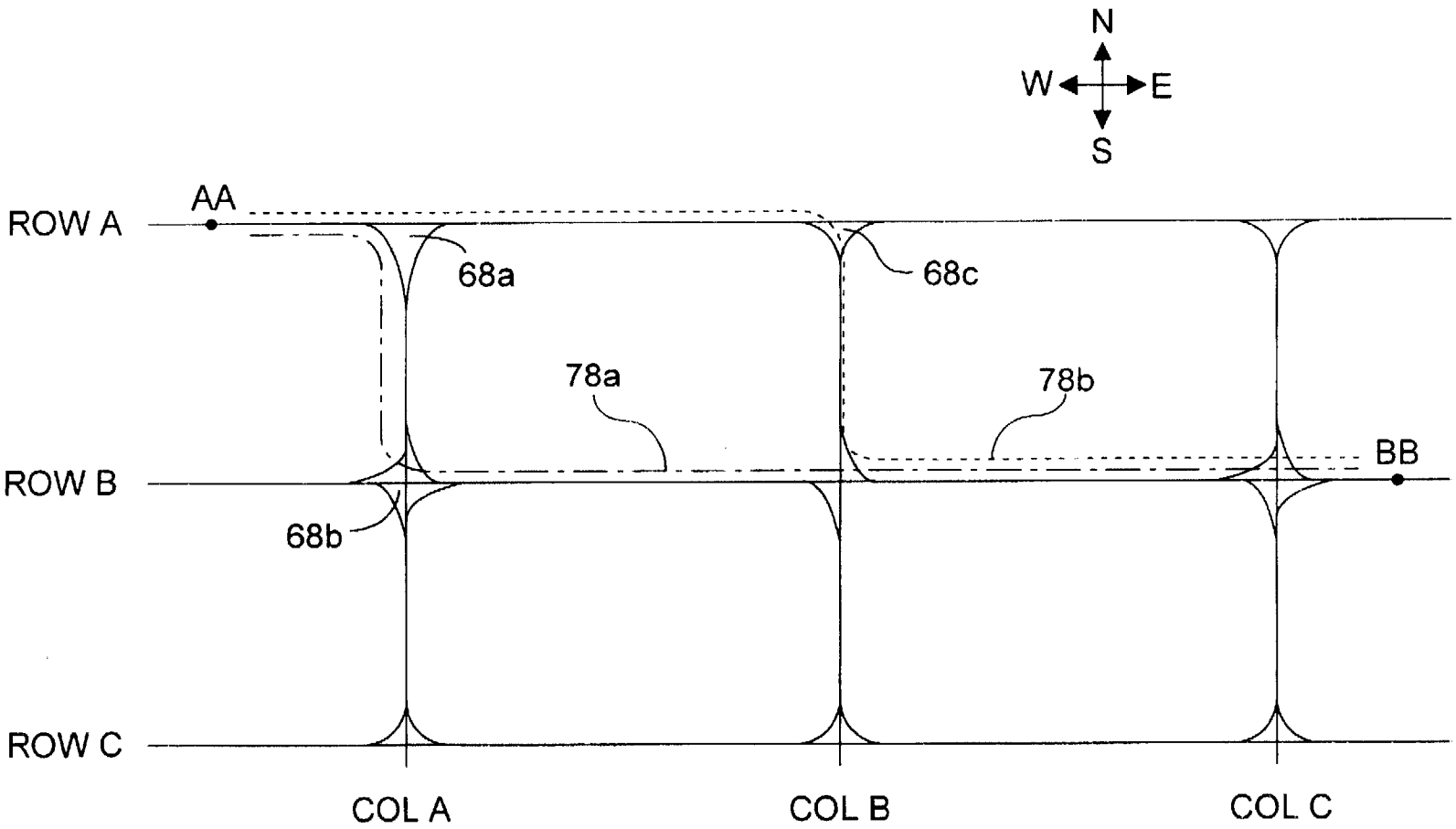
FIG. 11 illustrates a plan view of a portion of the network of tracks within the area served by the invention.

Referring now to FIG. 11, there is provided a plan view of a portion of the track means 22 of the network. As illustrated, the network is embodied as a plurality of row track sections, including ROW A, ROW B, and ROW C, and a plurality of column track sections, including COL A, COL B, and COL C. A first passenger station 42 is designated AA and will be referred to as "station AA". It can be assumed that station AA is the initial or first station from which passengers are to depart. A second passenger station 42 is designated BB and will be refereed to as "station BB". It can further be assumed that station BB is a destination or second station to which passengers are to be transported to (and will arrive at). Finally, assume a party of four passengers are to be transported. A typical passenger transport would commence at station AA with one of the individuals (of a party of individuals) using a travel credit card 104 to select a destination station and indicate the number of passengers to be transported. The destination station may be indicated by way of the station name and/or an assigned station code. Once the information is entered into the travel credit card, the information in the card is transferred to a station interface module 52 (via link 106), and eventually to the computing means 86. The computing means 86 would process the request and the associated information, and assign (possibly by way of the station interface unit 52 at station AA) a passenger vehicle 20 to pickup the party of individuals. If a vehicle is immediately available at the platform 44*a* of station AA, and a route with all required track merges and diverges can be determined and provided, the passengers may board the vehicle and begin their transport. If a route can not be determined, or the requested destination passenger station 42 is at or near capacity, a delay may be required before the individuals can be transported. Alternately, should a vehicle 20 not be immediately available, one may be dispatched from a holding track associated with station AA, or from another nearby location. A key feature of the present invention is the provision of a plurality routes that may be employed for each transport, including routes 78*a* and 78*b* shown in FIG. 11. Each such route may be utilized to transport passengers from the station AA to the station BB. For example, the route 78*a* may be employed wherein a passenger vehicle 20 (not shown) may depart the station AA heading EAST. At the first junction 68*a* encountered, the vehicle 20 traveling on route 78*a* would transfer to the track segment COL A, heading SOUTH. (This transfer from track segment ROW A to segment COL A may be effected by the computing means 86 transmitting control information to control junction 68*a*.) At the next junction 68*b*, a transfer to the track segment ROW B heading EAST would occur. The passenger vehicle 20 would then continue EAST on track section ROW B until the junction for the ramp track 22*b*(not shown) is reached at station BB. The passenger vehicle 20 would transfer to ramp track 22*b* (of station BB) and arrive at the station BB. Equivalently, a passenger vehicle 20 transporting passengers from station AA to station BB may utilize route 78*b* or other possible routes available within the network of tracks Accordingly, it must be understood that the mass transit system 100 of the invention may plan and define a route from a first station to a second station as a function of the actual vehicular traffic traversing particular portions of the network of tracks and the complex set of "merges" that are required along each respective route. As such the two routes 78*a* and 78*b* are intended to be illustrative only—many others may be possible to support this and other required passenger transfer requests.

It should be understood that the planning of a passenger transport from a first (initial) station to a second (destination) station will typically include the consideration by the computing means 86 of available empty slots 74' (shown in FIGS. 5A and 5B) on a plurality of the sections of main tracks 22*a* and ramp tracks 22*b*, and further include the use of destination concerned priority to determine if the selected destination station is at or near capacity. If the computing means 86 determines that no available route can be found, the computing means 86 will continue to attempt to schedule the transport at periodic intervals, possibly by considering a longer and somewhat "out of the way" route. If the computing means 86 determines that the requested destination station is at or near capacity, the transport will be delayed until the destination station is able to accept the arrival of one or more vehicles 20 and the associated passengers.

As mentioned to earlier, an operational feature contemplated for the operation of system 100 is to have the routes, including all junctions to be controlled, downloaded from the computing means 86 to a vehicle 20, and to have the vehicle 20 control the junctions and their associated track selection means along the route. Accordingly, the volume of information that would be exchanged between each respective vehicle 20 in transit on the main tracks and the computing means 86 may be minimized. In this operational scenario, each of the vehicles 20 approaching a respective junction 68 would indicate to the "controlling" track unit 64 (of the junction) how the junction should be arranged to properly route the vehicle 20 when it arrives. That is, the vehicles 20 may control the passage through each junction 68 along a traveled route.

While there have been described the currently preferred embodiments of the present invention, those skilled in the art will recognize that other and further modifications may be made without departing from the present invention and it is intended to claim all modifications and variations as fall within the scope of the invention.

What is claimed is:

1. An on-demand mass transit system to enable the non-stop transport of individuals from a first location to a second location, both locations within an area serviced by the system, the system comprising:

a) a plurality of self-propelled mass transit passenger vehicles, each passenger vehicle suitable to transport passengers from the first location to the second location;

b) a network of interconnected tracks including main tracks and holding tracks, the main tracks provided as the main conduits for the passenger vehicles to move within the network and the holding tracks provided to hold unoccupied vehicles that are available to be dispatched to transport passengers;

c) a plurality of passenger stations, including a first station at the first location and a second station at the second location, each passenger station removed and decoupled from the main track, located adjacent to at least one portion of the main track, and configured to support the pick-up and drop-off of passengers while not affecting the flow of vehicular traffic on the main track;

d) ramp means to enable passenger vehicles to move between the respective passenger stations and at least one of a portion of the main track and the holding track at each of the stations;

e) a plurality of station interface units, at least one installed in each of the plurality of passenger stations to enable individuals to request a pickup at the first station by one of the passenger vehicles and to specify the second station to be transported to; and f) computing means provided to control and coordinate the activities of the mass transit system, the computing means in communication with each station interface unit to enable the exchange of information between the computing means and the station interface units so as to process and coordinate the requests by individuals for transport, and further to process information received related to the position and speed of the plurality of the passenger vehicles in operation on the network of tracks to determine and provide appropriate control information;

g) the ramp means provided to (1) enable passenger vehicles that are not presently in use to be dispatched by the computing means from the holding track to the first station to pick up at least one passenger who has requested transport, (2) enable occupied passenger vehicles to move from the first station to the main track to commence transport to the second station, (3) to enable passenger vehicles to move from the main track to the second station to drop-off passengers, and (4) enable passenger vehicles to be moved from the second station to the associated holding track until the passenger vehicle is needed to transport additional passengers.

2. The system according to claim 1, further including a plurality of track units installed at spaced locations within the network and in communication with the computing means, each track unit provided to monitor the position and speed of vehicular traffic, and to establish short duration communication links with vehicles in the immediate vicinity of the respective track units to support the exchange of information between the computing means and the passenger vehicles.

3. The system according to claim 2, further including a plurality of track selection means provided to direct vehicles to one of a plurality of tracks connected at a junction location within the network, each track selection means installed in the vicinity of, and responsive to, at least one of the plurality of track units.

4. The system according to claim 3, wherein each passenger vehicle further includes a computing and communication module to establish periodic short duration communication links between the vehicle and the computing means via the track units, each communication link established to support the exchange of information including at least one of the location of the vehicle, the final destination of the vehicle, a proposed and assigned route, the number of passengers to be transported, track selection control information, and the expected arrival time at the second station.

5. The system according to claim 3, wherein each of a plurality of the track units include a bar code scanning module and each passenger vehicle is outfitted with a bar code indicia, the location of at least one passenger vehicle determined by track units scanning the bar code indicia of the vehicle as the vehicle passes the respective track units and then transmitting the scanned vehicle number to the computing means to indicate the exact location of the vehicle within the network of tracks.

6. The system according to claim 5, wherein a plurality of the track units are located at spaced locations with known distances between at least two successive track units, thereby supporting the determination of the velocity of respective passenger vehicles as the vehicles pass the successive track units.

7. The system according to claim 1, wherein the main tracks, the holding tracks, and the ramp means are provided by above ground monorail tracks and the passenger vehicles further include a plurality of stabilizing legs extending downward from the lower portion of a main passenger compartment of the respective vehicles along the sides of the monorail track and employ a holding arrangement to guide and increase the stability of the vehicles when in motion on the network of tracks.

8. The system according to claim 7, wherein the main tracks, the holding tracks, and the ramp means are provided having a triangular shaped cross section and a stepped sidewall, said stepped sidewall having an inwardly recessed lower portion associated with the holding o arrangement.

9. The system according to claim 1, wherein a plurality of the passenger stations are elevated with respect to the main tracks, thereby providing an incline to slow the passenger vehicles when approaching the passenger stations and accelerate the passenger vehicles when departing the passenger stations.

10. The system according to claim 1, further including a hand held travel credit card having a user interface means to enable individuals to enter and verify information related to transport requests, the travel credit card configured to communicate with the station interface units and to exchange information therewith related to at least one of the second station and the number and status of the passengers requiring transport.

11. The system according to claim 10, wherein the user interface means of the travel credit card includes a display unit, a keypad unit, and an audio output device.

12. An on-demand mass transit system including a network of interconnecting tracks extending within a service area, the tracks including main tracks and ramp tracks, the system comprising:

a) a plurality of passenger stations, each station located adjacent to at least one portion of the main track;

b) a plurality of passenger vehicles for transporting passengers from an initial passenger station to a destination passenger station via the network of tracks, the initial and destination passenger stations located within the service area;

c) a plurality of holding tracks to hold unoccupied vehicles that are available to be rapidly dispatched to transport passengers;

d) a plurality of station interface units, each installed in one of the passenger stations to enable individuals to provide information to the system, the information including at least one of (1) passenger pickup requests, (2) the destination station the individuals are to be transported to, (3) the number of passengers to be transported, and (4) any requests for the cancellation of requested passenger pickups;

e) computing means provided to control and coordinate the activities of the mass transit system, the computing means in communication with each station interface unit to enable the exchange of information between the computing means and the station interface units so as to process and coordinate the requests by individuals for transport, and further to process information received related to the plurality of the passenger vehicles in operation on the network of tracks to determine and provide appropriate vehicle and track control information; and f) track units installed at a plurality of spaced locations along the main tracks and the ramp tracks within the network, each track unit arranged to establish periodic communication links with passing vehicles to enable information to be exchanged between the computing means and the respective passing vehicles, the information exchanged used by at least one of the computing means and the track units to perform at least one of locating the vehicles, determining the speed of the vehicles, instructing the vehicles to increase their speed, instructing vehicles to decrease their speed, and informing vehicles of upcoming junctions within the network of tracks;

g) the ramp tracks interconnecting each passenger station with at least two portions of the main tracks, at least two portions of the holding tracks, and enabling the movement of passenger vehicles from one portion of the main tracks to another portion of the main tracks;

h) the computing means employing destination concerned priority when scheduling passenger transports to prevent station related bottlenecks and congestion.

13. The system according to claim 12 wherein the vehicles further include a computing and communication module to support the establishment of the periodic communication links with the track units.

14. The system according to claim 13, wherein each of a plurality of the track units include a bar code scanning module and each passenger vehicle is outfitted with a bar code indicia, the location of at least one passenger vehicle determined by track units scanning the bar code indicia of the vehicle as the vehicle passes the respective track units and then transmitting the scanned vehicle number to the computing means to indicate the exact location of the vehicle within the network of tracks.

15. The system according to claim 14, wherein at least one track unit is configured to determine the velocity of respective passenger vehicles as the vehicles pass the track unit.

16. The system according to claim 12, wherein the main tracks, the holding tracks, and the ramp tracks are provided by above ground monorail tracks having a triangular shaped cross section, and the passenger vehicles further include a plurality of stabilizing legs extending downward from the main passenger compartment of the vehicles along the side of the monorail track and employ a holding arrangement to guide and increase the stability of the vehicles when in motion on the network of tracks.

17. The system according to claim 16, wherein the holding arrangement includes tracks having a stepped sidewall, the stepped sidewall having an inwardly recessed lower portion.

18. A passenger station arrangement for use with an on-demand mass transit system, the mass transit system including a network of interconnecting main tracks to accommodate self-propelled vehicles and to enable passengers in the vehicles to be non-stop transported from a first location to a second location, each of the locations within the network of interconnecting main tracks, the station arrangement located adjacent to, but removed and decoupled from at least one portion of the main tracks, the station arrangement comprised of:

a) at least one holding track provided to hold unoccupied vehicles that are available to be dispatched to transport passengers;

b) at least one platform to enable the loading of passengers onto vehicles departing from the station arrangement and to enable the unloading of passengers from vehicles arriving at the station, the at least one platform housed in a building, with the building providing a departure room for use by individuals requesting transport from the station arrangement and an arrival room for use by individuals who are arriving at the station, the departure room and the arrival room providing access to the platform;

c) ramp means to enable passenger vehicles to move between the platform and at least one of a portion of the main tracks and a portion of the holding track; and d) at least one station interface unit installed in the station arrangement to enable at least one individual to request a pickup at the platform by one of the passenger vehicles, to indicate the second station arrangement to be transported to, and to indicate the number of passengers to be transported.

19. The passenger station arrangement according to claim 18, wherein respective platforms may be elevated with respect to the main tracks, thereby providing an incline to slow passenger vehicles when entering the station arrangement and accelerate the passenger vehicles when departing the station arrangement.

* * * * *